US009776220B2

(12) United States Patent
Noda et al.

(10) Patent No.: US 9,776,220 B2
(45) **Date of Patent: *Oct. 3, 2017**

(54) CYLINDER HEAD CLEANING METHOD AND CYLINDER HEAD CLEANING DEVICE

(71) Applicant: TOYOTA JIDOSHA KABUSHIKI KAISHA, Toyota-shi (JP)

(72) Inventors: Hiroshi Noda, Toyota (JP); Katsuhiro Amaike, Miyoshi (JP); Masato Yoshida, Toyota (JP); Takashi Ooura, Toyota (JP); Hiromi Harada, Kasugai (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 133 days.

This patent is subject to a terminal disclaimer.

(21) Appl. No.: 14/632,560

(22) Filed: Feb. 26, 2015

(65) Prior Publication Data

US 2015/0165487 A1 Jun. 18, 2015

Related U.S. Application Data

(63) Continuation of application No. 12/740,190, filed as application No. PCT/JP2008/072287 on Dec. 9, 2008, now Pat. No. 9,079,224.

(30) Foreign Application Priority Data

Dec. 13, 2007 (JP) ..... 2007-321978

(51) Int. Cl.
*B08B 9/093* (2006.01)
*B08B 9/00* (2006.01)
(Continued)

(52) U.S. Cl.
CPC ..... *B08B 9/00* (2013.01); *B08B 3/02* (2013.01); *B08B 9/0933* (2013.01); *F02F 1/36* (2013.01)

(58) Field of Classification Search
CPC ... B08B 9/00; B08B 9/093; B08B 3/02; F02F 1/36
See application file for complete search history.

(56) References Cited

U.S. PATENT DOCUMENTS 3,989,537 A 11/1976 Sickmeier
4,665,655 A 5/1987 Woodard
(Continued)

FOREIGN PATENT DOCUMENTS

DE 102007012979 9/2008
JP 55 59876 5/1980
(Continued)

OTHER PUBLICATIONS

Extended Search Report issued Sep. 27, 2011 in European Patent Application No. 08859479.1-2307/2230392.

*Primary Examiner* — Saeed T Chaudhry
(74) *Attorney, Agent, or Firm* — Oblon, McClelland, Maier & Neustadt, L.L.P.

(57) ABSTRACT

A cylinder head cleaning method capable of cleaning a cylinder head with an enhanced foreign matter removing rate. The method is used to clean a cylinder head (1) having therein a water jacket (15) including a narrow space portion (Z) having a narrow flow path and a large space (Y) having a flow path wider than the narrow space portion (Z), and the cylinder head (1) further having holes (12A-12R, 13, 14, 16A-16C) communicating with the water jacket (15). Cleaning nozzles (28A, 28C) are inserted into the water jacket (15) from the holes (16A, 16C) selected from the holes (12A-12R, 13, 14, 16A-16C), clearing liquid is ejected from the cleaning nozzles (28A, 28C) toward the narrow space
(Continued)

portion (Z), and the cleaning liquid flowing from the narrow space portion (Z) to the large space (Y) is discharged to the outside of the cylinder head (1) from the hole (16B) communicating with the space (Y).

11 Claims, 22 Drawing Sheets

(51) Int. Cl.
*B08B 3/02* (2006.01)
*F02F 1/36* (2006.01)

(56) References Cited

U.S. PATENT DOCUMENTS

| | | | | |
|---|---|---|---|---|
| 4,805,563 | A | 2/1989 | Nishimura et al. | |
| 7,086,355 | B2 | 8/2006 | Yamamoto | |
| 8,662,028 | B2 * | 3/2014 | Knollmayr | 123/41.82 R |
| 2003/0221641 | A1 | 12/2003 | Oh | |

FOREIGN PATENT DOCUMENTS

| | | |
|---|---|---|
| JP | 61 101281 | 5/1986 |
| JP | 61 153187 | 7/1986 |
| JP | 62 279256 | 12/1987 |
| JP | 2589637 | 3/1997 |
| JP | 2000 157939 | 6/2000 |
| JP | 2005 111444 | 4/2005 |

* cited by examiner

CYLINDER HEAD CLEANING METHOD AND CYLINDER HEAD CLEANING DEVICE

CROSS-REFERENCE TO RELATED APPLICATIONS

This application is a continuation of U.S. application Ser. No. 12/740,190, filed Apr. 28, 2010, which is a National Stage of PCT/JP08/072287, filed Dec. 9, 2008, and claims the benefit of priority under 35 U.S.C. 119 of Japanese Patent Application No. 2007-321978, filed Dec. 13, 2007, the entire contents of which are incorporated herein by reference.

TECHNICAL FIELD

The present invention relates to a cylinder head cleaning method of cleaning a water jacket in a cylinder head and a cylinder head cleaning device.

BACKGROUND ART

Vehicle engines widely adopt cylinder heads and cylinder blocks made of aluminum alloy for the purpose of reducing the weight and providing cooling performance. The cylinder head has a complicated structure internally including intake ports for mounting intake valves, exhaust ports for mounting exhaust valves, spark plug holes for mounting spark plugs, part of combustion chambers for exploding fuel, a water jacket for allowing cooling water to circulate, and others. The cylinder head is usually produced by casting using a number of sand cores to integrally form the intake ports, the exhaust ports, the water jacket, and others. Accordingly, the cylinder head is formed with sand removing holds to remove the sand cores by crushing or shattering them after the cylinder head is taken out of a casting mold. The cylinder head from which the cores have been removed is then subjected to machining, for example, to form bolt holes by a drill or the like or grind the surface of each port. If foreign matters such as sand of the cores and chippings or cuttings resulting from the machining stay in the cylinder head, product quality in an engine may be deteriorated. Therefore, the processed cylinder head is heretofore subjected to cleaning for removing the foreign matters.

For instance, Patent Literature 1 discloses a technique for cleaning a cylinder head by rotating the cylinder head grasped with a clamp, ejecting cleaning liquid through cleaning nozzles arranged around the cylinder head toward the cylinder head. A cylinder head cleaning method and a cylinder head cleaning device in Patent Literature 1 are configured to move the cleaning nozzles toward or away from the cylinder head to maintain a fixed distance between the nozzles and the cylinder head. Accordingly, the cleaning liquid ejected from each nozzle effectively acts on all surfaces of the cylinder head to be cleaned, thus achieving better cleaning effects.

However, the cylinder head cleaning method disclosed in Patent Literature 1 is conducted by ejecting the cleaning liquid from outside of the rotating cylinder head. Thus, the cleaning liquid entering in the water jacket flows slowly at a flow velocity of 0.5 m/s and in a small flow amount and therefore could not produce a flow in the water jacket. A cleaned cylinder head is normally subjected to visual checks by a person for checking whether or not foreign matters remain in the cylinder head through a microscope or the like. If foreign matters are found, they are removed one by one by hand. Regarding the cylinder head cleaned by the cylinder head cleaning method of Patent Literature 1, about 80% of foreign matters found in one cylinder head would be found in the water jacket. Therefore, the cylinder head cleaning method and the cylinder head cleaning device of Patent Literature 1 could not sufficiently clean the water jacket.

On the other hand, Patent Literatures 2 and 3 propose techniques of cleaning the inside of a water jacket in which foreign matters are apt to remain.

The cylinder head cleaning method and cylinder head cleaning device of Patent Literature 2 are configured such that, as first to third cleaning steps shown in FIGS. 24A to 24C, while compressed air is supplied to holes 103*c*, 103*d*, and 103*e* communicating with recesses 102*a*, 102*b*, and 102*c* of a water jacket 102 formed in a cylinder head 101, cleaning nozzles 104, 105, and 106 are selectively sequentially brought into contact with holes 103*a*, 103*b*, and 103*f* communicating with the water jacket 102, thereby ejecting cleaning liquid W from the cleaning nozzles 104, 105, and 106. Accordingly, different flows are created near the recesses 102*a*, 102*b*, and 102*c* of the water jacket 102, thereby discharging and removing the foreign matters remaining in the recesses 102*a*, 102*b*, and 102*c* together with the cleaning liquid W to the outside of the cylinder head 101.

The cylinder head cleaning method and the cylinder head cleaning device of Patent Literature 3 are configured such that as shown in FIG. 25 a moving means 209 brings a plurality of nozzles 204, 205, 206, 207, and 208 provided in a cleaning bath 201 and a seal pad 213 into close contact with hole parts 210*b* to 210*g* selected from a plurality of hole parts 210*b* to 210*j* formed in a cylinder head 210. In a cleaning liquid process device 202, cleaning liquid W filtered through a filter 212 is fed to each of the nozzles 204 to 208 from a cleaning liquid supply pump 203 and ejected into the hole part 210*b* to 210*g* at high pressure. The cleaning liquid W forms flows while causing turbulent flows in a water jacket 210*a*, thereby cleaning the inside of the water jacket 210*a*. Foreign matters remaining in the water jacket 210*a* are sucked in the flows of the cleaning liquid W and thus discharged together with the cleaning liquid W through the hole parts 210*h*, 210*i*, and 210*j* into the cleaning bath 201.

CITATION LIST

Patent Literature

Patent Literature 1: JP 2589637
Patent Literature 2: JP 61(1986)-153187A
Patent Literature 3: JP 2005-111444 A

SUMMARY OF INVENTION

Technical Problem

However, in the cylinder head cleaning method and the cylinder head cleaning device disclosed in Patent Literatures 2 and 3, the cleaning liquid ejected from the cleaning nozzles 104 to 106 and 204 to 208 would lower the flow velocity and the fluid pressure before the cleaning liquid flow reaches a narrow flow path (hereinafter, referred to as a "narrow space portion") in each water jacket 102, 210*a*. Thus, the cleaning liquid could not remove or carry away foreign matters caught in the narrow space portions. The details thereof are described as below.

Each of the water jackets 102 and 210*a* includes a flow path having a width of about 4.67 mm between a wall defining a spark plug hole and a wall defining the intake port and a flow path having a width of about 3.50 mm between the wall defining the spark plug hole and a wall defining the exhaust port. Accordingly, a number of narrow space portions forming narrow flow paths are provided. Some of the crushed cores are larger than the 3.50 mm width of the flow path. Most of the chippings have a curled or crescent shape. Thus, the foreign matters such as the broken cores and chippings are apt to be caught in the narrow space portions of the water jackets 102 and 210*a* and hard to remove.

On the other hand, the cylinder head cleaning method and the cylinder head cleaning device disclosed in Patent Literature 2 is configured to place the nozzles 104 to 105 in close contact with the holes 103*a* and 103*b* respectively opening in an upper surface of the cylinder head 101 as shown in FIGS. 24B and 24C and eject the cleaning liquid W toward a lower side of the water jacket 102. The cleaning liquid W ejected from the nozzles 104 to 106 impinges on a lower wall of the water jacket 102, greatly attenuating energy, and then flows in the holes 103*f* and 103*g*. In the cylinder head cleaning method and the cylinder head cleaning device disclosed in Patent Literature 2, furthermore, even when the cleaning liquid W is ejected from the nozzle 106 placed in contact with the hole 103*f* opening in a side surface of the cylinder head 101, as shown in FIGS. 24A and 24C, the cleaning liquid W also impinges on an inner wall of the water jacket 102, greatly attenuating energy, and then flows in the holes 103*a*, 103*b*, and 103*g* apart from the hole 103*f*. Accordingly, the cylinder head cleaning method and the cylinder head cleaning device disclosed in Patent Literature 2 would cause attenuation of energy before the cleaning liquid flow reaches the narrow space portions. Thus, the flow velocity and the flow pressure decrease. Such cleaning liquid flow therefore could not sweep away and remove the foreign matters caught in the narrow space portions.

The cylinder head cleaning method and the cylinder head cleaning device disclosed in Patent Literature 3 are configured to eject the cleaning liquid W while placing the nozzles 204 to 208 in contact with the holes 210*b*, 210*d* to 210*g* opening in an upper surface and a side surface of the cylinder head 201. In this case, similarly, immediately after being ejected, the cleaning liquid flow impinges on an inner wall of the water jacket 210*a*, attenuating energy. At or around the time when the cleaning liquid flow reaches the narrow space portions, the flow velocity and the flow pressure have remarkably decreased. Thus, such liquid could not sweep away and remove the foreign matters caught in the narrow space portions.

The present invention has been made to solve the above problems and has a purpose to provide a cylinder head cleaning method and a cylinder head cleaning device capable of improving the rate of removal of foreign matters.

Solution to Problem

The cylinder head cleaning method and the cylinder head cleaning device according to the present invention have the following configurations.

(1) One aspect of the invention provides a cylinder head cleaning method of cleaning a cylinder head internally comprising: a water jacket including a narrow space portion forming a narrow flow path and a large space portion forming a wider flow path than in the narrow space portion; and a plurality of holes each communicating with the water jacket, the method comprising: inserting cleaning nozzles in the water jacket through selected holes of the holes; ejecting cleaning liquid through the cleaning nozzles toward the narrow space portion; and discharging the cleaning liquid flowing from the narrow space portion to the large space portion to the outside of the cylinder head through the hole communicating with the large space portion.

(2) In the invention set forth in (1), preferably, the holes are selected to cause the cleaning liquid to flow in opposite directions with respect to the large space portion.

(3) In the invention set forth in (1) or (2), preferably, the cylinder head comprises: a plurality of spark plug holes in each of which a spark plug is to be mounted; intake ports communicated with a plurality of combustion chambers provided in correspondence with the spark plug holes, the intake ports being used for taking in air; and exhaust ports communicated with the combustion chambers and used for discharging exhaust gas, the narrow space portion is a space formed between a wall defining each spark plug hole and a wall defining each intake port or a wall defining each exhaust port, and the large space portion is a space formed between the walls defining the spark plug holes.

(4) In the invention set forth in one of (1) to (3), preferably, the cleaning nozzles are rotated in the water jacket.

(5) In the invention set forth in one of (1) to (4), preferably, the cleaning nozzles are inserted in the selected holes and cleaning is conducted, and then the cleaning nozzle is inserted in the unselected hole and cleaning is conducted.

(6) In the invention set forth in one of (1) to (5), preferably, when one of the holes communicating with the large space portion is to be used as a discharge hole of the cleaning liquid, the holes located on both sides of the discharge hole are selected as holes in which the cleaning nozzles are to be inserted.

(7) In the invention set forth in one of (1) to (6), preferably, the cleaning liquid is supplied into the water jacket through a hole provided in a surface of the cylinder head, the surface being defined as a lower surface of the cylinder head during cleaning.

(8) The invention set forth in one of (1) to (7), preferably, further comprising: placing a cleaning liquid discharge member on an upper surface of the cylinder head, the cleaning liquid discharge member including first flow paths through which the cleaning nozzles are to be inserted and second flow paths branching off from the first flow paths and opening on the side of a side surface of the cylinder head, so that the first flow paths are brought into communication with the holes opening in the upper surface of the cylinder head; stopping the cleaning nozzles corresponding to the selected holes in a first stop position where each nozzle protrudes from the first flow path into the water jacket; and stopping the cleaning nozzles corresponding to the hole other than the selected holes in a second stop position to allow the second flow path to branch off from the first flow path.

(9) The invention set forth in one of (1) to (8), preferably, further comprising: swinging the cleaning nozzle placed near a hole of the holes, the hole being formed to open in the side surface of the cylinder head and ejecting the cleaning liquid toward the narrow space portion to discharge the cleaning liquid flowing from the narrow space portion to the large space portion to the outside of the cylinder head through the hole communicating with the large space portion.

(10) Another aspect of the invention provides a cylinder head cleaning device for cleaning a cylinder head internally comprising: a water jacket including a narrow space portion forming a narrow flow path and a large space portion forming a wider flow path than in the narrow space portion; and a plurality of holes each communicating with the water jacket, the device comprising: a table for holding the cylinder head in place; first cleaning nozzles placed above the table and in correspondence with the holes opening in an upper surface of the cylinder head held on the table; and a drive unit for linearly and reciprocally moving the first cleaning nozzles up and down in a vertical direction relative to the table.

(11) In the invention set forth in (10), preferably, the drive unit rotates the first cleaning nozzles through which the cleaning liquid is ejected.

(12) The invention set forth in (10) or (11), preferably, further comprising a second cleaning nozzle for supplying the cleaning liquid to the hole opening in a lower surface of the cylinder head held on the table.

(13) The invention set forth in one of (10) to (12), preferably, further comprising a cleaning liquid discharge member placed on an upper surface of the cylinder head and provided with first flow paths through which the first cleaning nozzles are inserted and second flow paths branching off from the first flow paths and opening in a side, the driving unit being configured to stop the first cleaning nozzles in a first stop position where the first cleaning nozzles protrude from the first flow paths into the water jacket and in a second stop position to allow the second flow paths to branch off from the first flow paths.

(14) The invention set forth in one of (10) to (13), preferably, further comprising: a third cleaning nozzle provided to be movable close to the hole opening in the side surface of the cylinder head; and a swing unit for swinging the third cleaning nozzle.

Advantageous Effects of Invention

In the cylinder head cleaning method and the cylinder head cleaning device having the above configurations, the cleaning nozzles (the first cleaning nozzles) is inserted in or placed near the hole selected from the holes of the cylinder head, and the cleaning liquid is directly ejected at the foreign matters caught in the narrow space portion of the water jacket. The cleaning liquid impinges on the foreign matters while maintaining an initial velocity and a flow rate since ejection from the nozzles, thereby sweeping away the foreign matters from the narrow space portion to the large space portion. The foreign matters flowing in the large space portion is discharged and removed together with the cleaning liquid to the outside of the cylinder head through the hole communicating with the large space portion. The aforementioned cylinder head cleaning method and the cylinder head cleaning device can sufficiently remove the foreign matters caught in the narrow space portion of the water jacket, thereby enhancing the rate of removal of the foreign matters.

Accordingly, when a person visually checks the inside of the cylinder head cleaned by the aforementioned cylinder head cleaning method and the cylinder head cleaning device, less foreign matters are found. This greatly saves the trouble of removing the foreign matters by hand.

In the above cylinder head cleaning method, the nozzles are inserted in or placed near the selected holes to cause the cleaning liquid to flow in opposite directions with respect to the large space portion and thereby cause the cleaning liquid jets ejected from the nozzles to join together in the large space portion and be discharged through the hole communicating with the large space portion. This makes it possible to discharge the foreign matters out of the cylinder head without allowing the foreign matters to enter another narrow space portion again.

In the above cylinder head cleaning method, the cleaning liquid is ejected toward the large space portion formed between each of the walls forming the spark plug holes from the narrow space portion between ach of the walls forming the spark plug holes and each of the walls forming the intake ports or each of the walls forming the exhaust ports. Accordingly, the narrow space portion and the large space portion are communicated at short distances, which can remove the foreign matters without allowing the foreign matters to enter another narrow space portion again.

In the above cylinder head cleaning method and cylinder head cleaning device, the nozzle(s) inserted in or placed near the selected hole(s) is rotated or swung for cleaning. Accordingly, it is possible to eject the cleaning liquid from one hole at a plurality of the narrow space portions to clean them. Cleaning efficiency is thus high.

In the above cylinder head cleaning method, the nozzle(s) is inserted in the selected hole(s) to perform cleaning of the water jacket to remove the foreign matters from a predetermined cleaning space, and then the nozzle(s) is inserted in the hole(s) not selected to perform cleaning of the water jacket to remove the foreign matters from another cleaning space. In the above cylinder head cleaning method, the water jacket is intermittently subjected to cleaning in such a manner that the water jacket is divided into a plurality of cleaning spaces to evenly clean the entire inside of the water jacket. Accordingly, it is possible to prevent the foreign matters removed from a certain narrow space portion from becoming caught in another narrow space portion and staying in the water jacket.

In the above cylinder head cleaning method, when one of the holes communicating with the large space portion is used as a discharge hole for the cleaning liquid, the holes arranged on both sides of the discharge hole are selected as holes in which the cleaning nozzles are inserted. Accordingly, the cleaning liquid jets ejected from the cleaning nozzles flow in opposite directions and collide with each other in the large space portion and hence easily flow out of the cylinder head through the discharge hole.

In the above cylinder head cleaning method and the cylinder head cleaning device, the cleaning liquid is supplied to a hole provided in a surface which is defined as a lower surface of the cylinder head during cleaning to place the water jacket in a pseudo in-water state. Thus, the foreign matters remaining in the water jacket are given buoyancy and become easy to be removed from the narrow space portions and others. The energy of the cleaning liquid ejected from the nozzles is hard to attenuate while the cleaning liquid flows from the narrow space portion to the large space portion as compared with an in-air state where the inside of the water jacket is not immersed with water. According to the cylinder head cleaning method and cylinder head cleaning device described above, the flow velocity and the flow pressure are unlikely to decrease for a period from the time when the cleaning liquid is ejected to the time when the cleaning liquid passes through the narrow space portion and reaches the large space portion. Thus, the foreign matters are easily swept away from the narrow space portion to the large space portion. The rate of removal of foreign matters can therefore be further enhanced.

In the above cylinder head cleaning method and cylinder head cleaning device, the first flow path(s) of the cleaning liquid discharge member is connected to the hole(s) opening in the upper surface of the cylinder head during cleaning of the cylinder head and the first nozzle(s) is inserted in the first flow path(s). The first nozzle(s) corresponding to the selected hole(s) is inserted in the water jacket and stopped in the first stop position, while the first nozzle(s) corresponding to the unselected hole(s) is stopped in the second stop position at which the second flow path(s) branches off from the first flow path(s). Then, the cleaning liquid is ejected from the first nozzle(s) inserted in the selected hole(s). The upper opening(s) of the first flow path(s) communicating with the unselected hole(s) is blocked off by the first cleaning nozzle(s). Accordingly, the cleaning liquid flows from the first flow path(s) connected to the unselected hole(s) to the second flow path(s), and flows out on the side of the side surface of the cylinder head. Consequently, the above cylinder head cleaning method and cylinder head cleaning device can prevent the foreign matters removed out of the cylinder head from entering the cylinder head again.

REFERENCE SIGNS LIST

1 Cylinder head
2A, 2B, 2C, 2D Spark plug hole
7A, 7B, 7C, 7D Combustion chamber
8A, 8B, 8C, 8D Intake port
10A, 10B, 10C, 10D Exhaust port
12A, 12B, 12C, 12D, 12E, 12F Cooling-water communication path (Hole)
13 Water jacket port (Hole)
14 Cooling-water outlet (Hole)
15 Water jacket
16A, 16B, 16C Sand removing hole (Hole)
20 Cylinder head cleaning device
22 Table
23 Cleaning liquid discharge member
25A, 25B, 25C First flow path
26A, 26B, 26C Second flow path
28A, 28B, 28C First cleaning nozzle
30A, 30B, 30C Drive motor (Drive means)
32A, 32B, 32C, 32D, 32E, 32F Second cleaning nozzle
34A, 34B Third nozzle
40*a*, 40B Swing unit
ZA1 to ZD4 Narrow space portion
YA to YE Large space portion
X1 First stop position
X2 Second stop position

DESCRIPTION OF EMBODIMENTS

A detailed description of a preferred embodiment of a cylinder head cleaning method and a cylinder head cleaning device according to the present invention will now be given referring to the accompanying drawings.

<Schematic Configuration of Cylinder Head>

Figure 1:
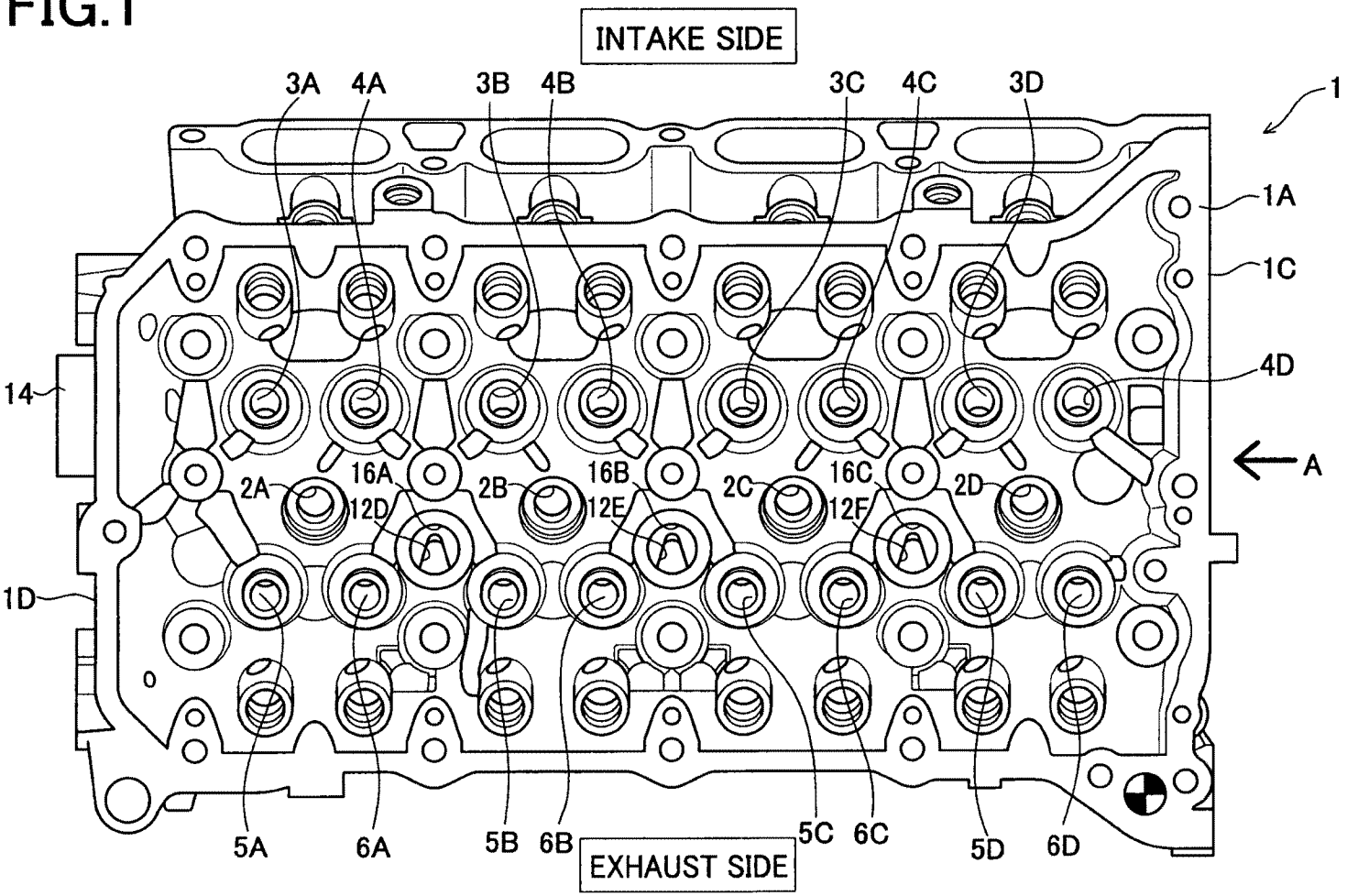
FIG. 1 is an upper view of a cylinder head in an embodiment of the invention, showing a surface (an upper surface) of the cylinder head which will contact with a cylinder cover.
Figure 2:
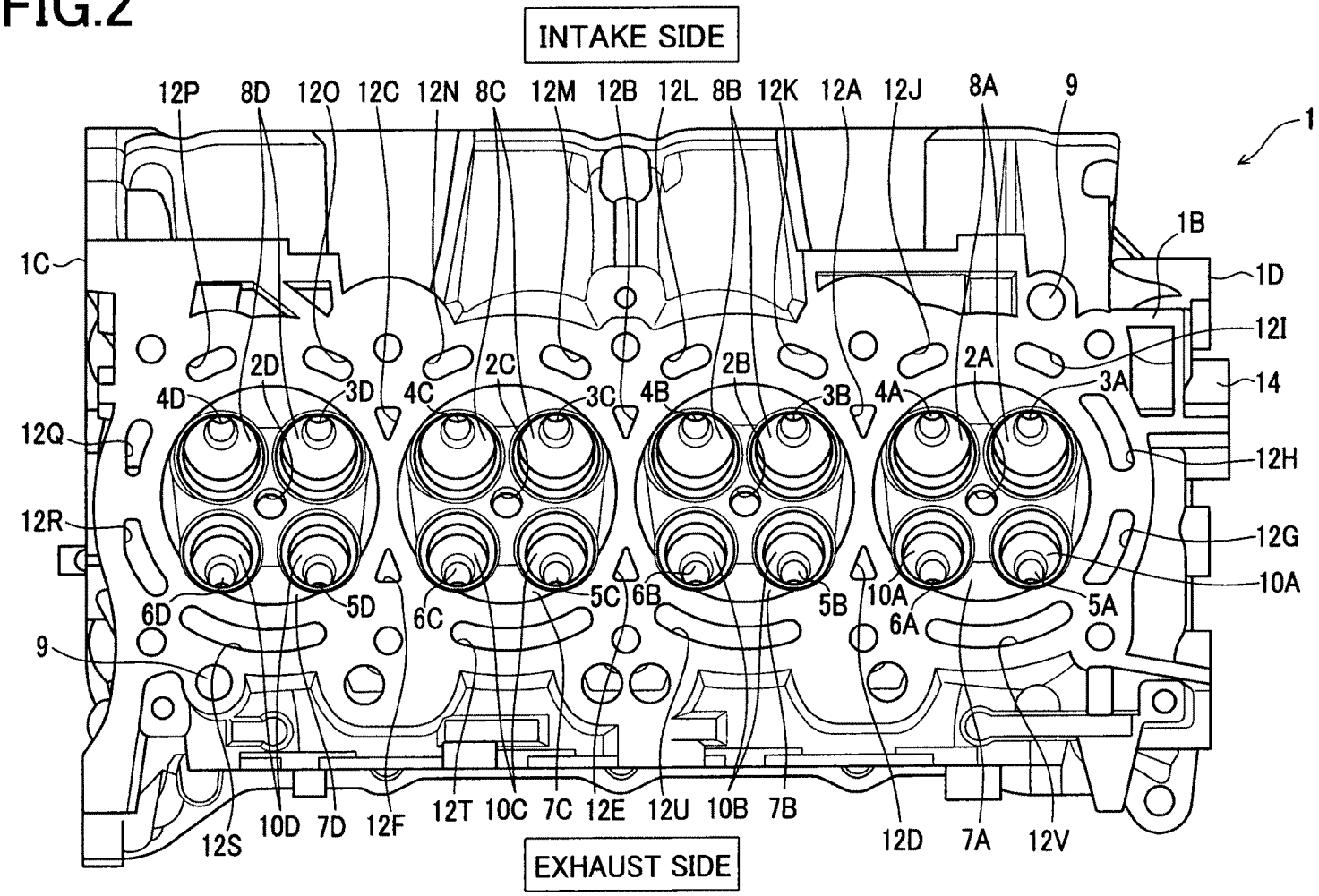
FIG. 2 is a lower view of the cylinder head shown in FIG. 1, showing a surface (a lower surface) of the cylinder head which will contact with a cylinder body.
Figure 3:
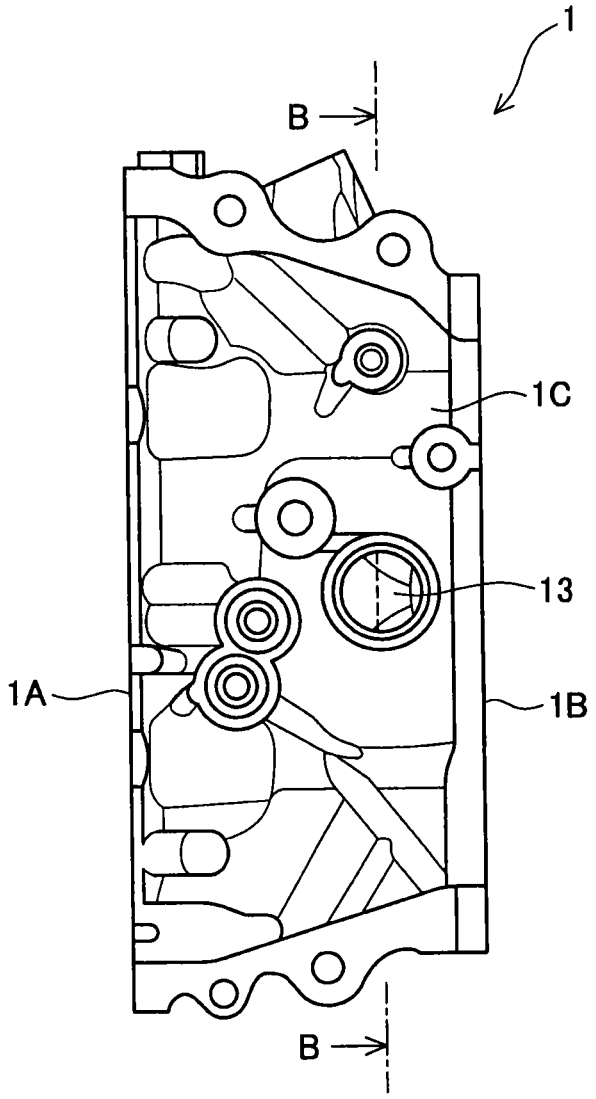
FIG. 3 is a side view of the cylinder head shown in FIG. 1, viewed from an arrow A in FIG. 1.
Figure 4:
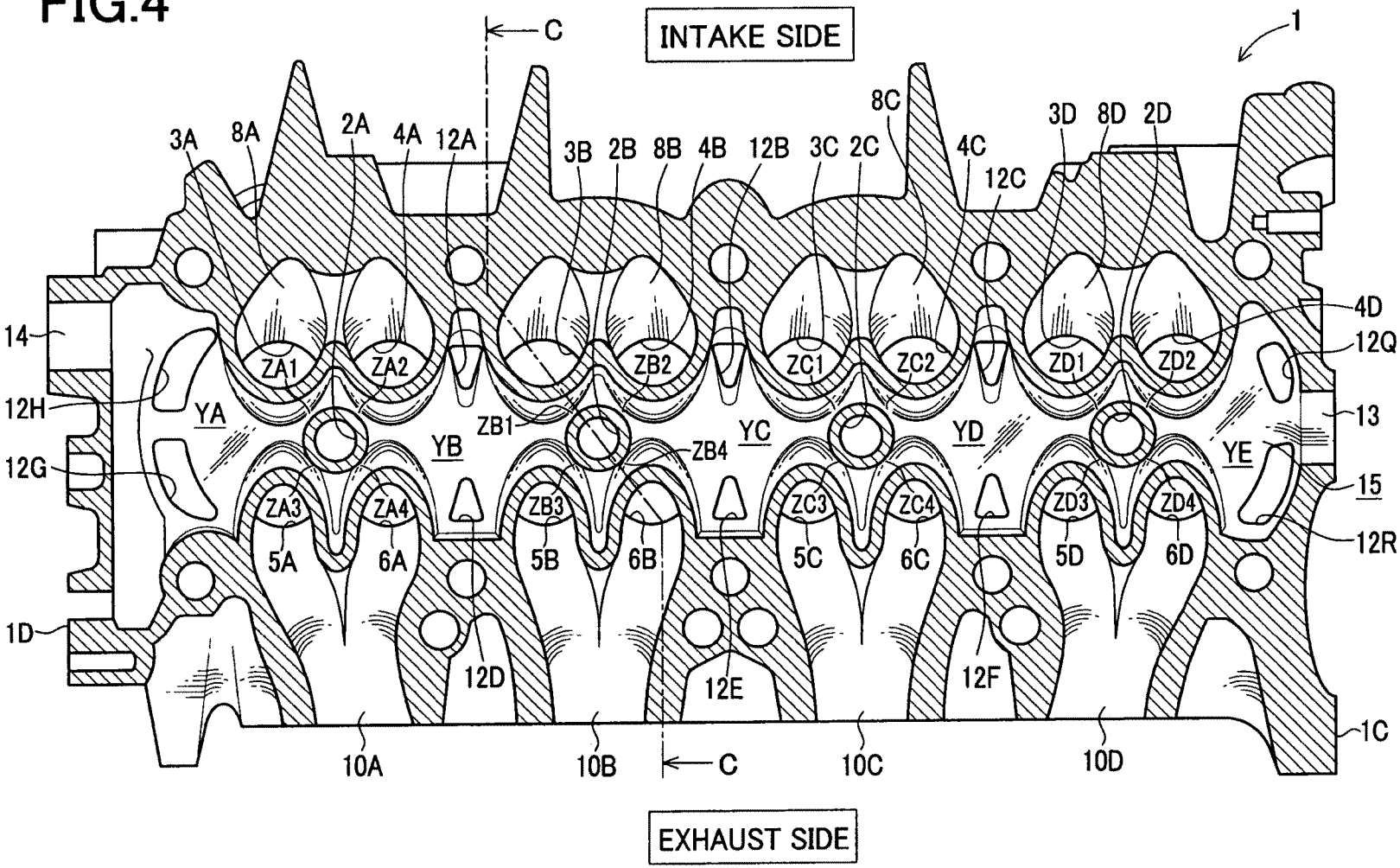
FIG. 4 is a sectional view taken along a line B-B in FIG. 3.
Figure 5:
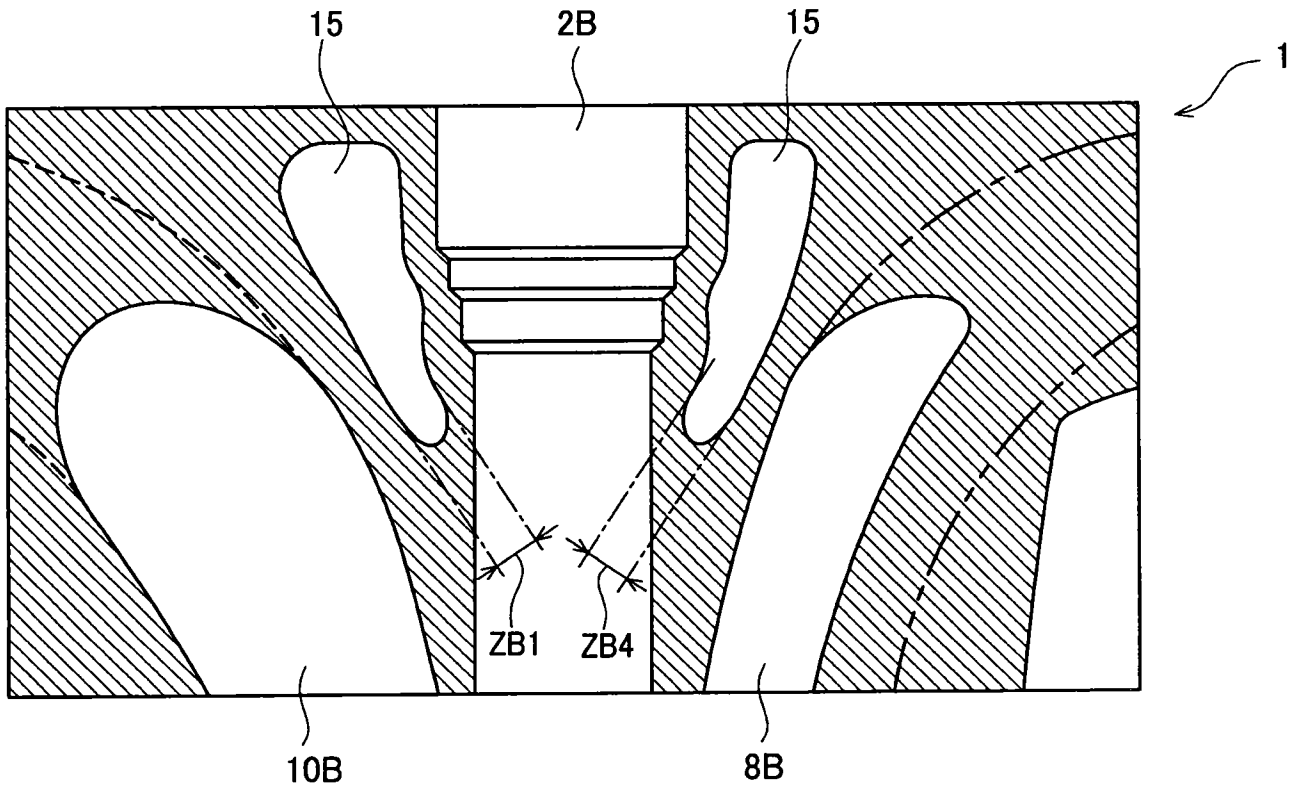
FIG. 5 is a sectional view taken along a line C-C in FIG. 4.

FIG. 1 is an upper view of a cylinder head 1 in this embodiment, showing a surface (an upper surface) 1A of the cylinder head 1 which will contact with a cylinder cover (not shown). FIG. 2 is a lower view of the cylinder head 1 of FIG. 1, showing a surface (a lower surface) 1B of the cylinder head 1 which will contact with a cylinder body (not shown). FIG. 3 is a side view of the cylinder head of FIG. 1, viewed from an arrow A in FIG. 1. FIG. 4 is a sectional view taken along a line B-B in FIG. 3. FIG. 5 is a sectional view taken along a line C-C in FIG. 4.

The cylinder head 1 shown in FIGS. 1 to 5 is to be used in a four-cylinder engine. The cylinder head 1 is made of aluminum alloy and has a complicated shape including component-mounting holes 2A, 3A, 4A, 5A, 6A, . . . communicating with a plurality of combustion chambers 7A, a water jacket 15 in which cooling water flows, and others.

As shown in FIG. 2, the cylinder head 1 is formed, in the lower surface 1B which will contact with a cylinder block (not shown), with four combustion chambers 7A, 7B, 7C, and 7D corresponding to the number of cylinders of the engine. As shown in FIGS. 1, 2, 4, and 5, the cylinder head 1 is provided with spark plug holes 2A, 2B, 2C, and 2D for mounting spark plugs (not shown) in correspondence with the combustion chambers 7A, 7B, 7C, and 7D, each hole 2A to 2D being formed through from the upper surface 1A to the lower surface 1B. The cylinder head 1 is further provided, around each spark plug hole 2A, 2B, 2C, and 2D, with pairs of inlet ports 3A, 3B, 3C, 3D, 4A, 4B, 4C, and 4D for mounting inlet valves and pairs of outlet ports 5A, 5B, 5C, 5D, 6A, 6B, 6C, and 6D for mounting outlet valves, each port being formed through from the upper surface 1A to the lower surface 1B. As shown in FIG. 2, the lower surface 1B of the cylinder head 1 is provided with positioning holes 9 arranged in diagonal relation.

As shown in FIG. 4, the paired inlet ports 3A, 3B, 3C, 3D, 4A, 4B, 4C, and 4D communicate with the intake ports 8A, 8B, 8C, and 8D connected to an intake manifold (not shown). On the other hand, the paired outlet ports 5A, 5B, 5C, 5D, 6A, 6B, 6C, and 6D communicate with the exhaust ports 10A, 10B, 10C, and 10D connected to an exhaust manifold (not shown).

In the inside of the cylinder head 1 (between the upper surface 1A and the lower surface 1B), as shown in FIGS. 4 and 5, the water jacket 15 is formed between the walls defining the spark plug holes 2A, 2B, 2C, and 2D, the walls defining the intake ports 8A, 8B, 8C, and 8D, and the walls defining the exhaust ports 10A, 10B, 10C, and 10D. The water jacket 15 communicates with a water jacket port 13 (en example of a "hole") opening in a right side surface 1C of the cylinder head 1 and a cooling-water outlet 14 opening in a left side surface 1D of the cylinder head 1. As shown in FIG. 2, cooling-water communication paths 12A to 12R (an example of the "hole") are open in the lower surface of the cylinder head 1, so that they are connected in communication with a water jacket (not shown) formed in a cylinder block (not shown) during assembly of an engine.

As shown in FIG. 5, the water jacket 15 is configured such that a flow path formed between each wall defining each spark plug hole 2A, 2B, 2C, and 2D and each wall defining each intake port 8A, 8B, 8C, and 8D has a narrow width of 4.67 mm and a flow path formed between each wall defining each spark plug hole 2A, 2B, 2C, and 2D and each wall defining each exhaust port 10A, 10B, 10C, and 10D has a narrow width of 3.50 mm. Thus, a plurality of narrow space portions ZA1, ZA2, ZA3, ZA4, ZB1, ZB2, ZB3, ZB4, ZC1, ZC2, ZC3, ZC4, ZD1, ZD2, ZD3, and ZD4 forming narrow flow paths are provided. The narrow space portions ZA1, ZA2, . . . communicate with large space portions YA, YB, YC, YD, YE each forming wider flow paths than the narrow space portions ZA1, ZA2, . . . . The large space portions YA, YB, YC, . . . communicate with the cooling-water communication paths 12A to 12R respectively. The large space portions YB, YC, and YD communicate with sand removing holes 16A, 16B, and 16C (see FIG. 1).

The cylinder head 1 shown in FIGS. 1 to 5 is manufactured by casting using a plurality of sand cores, machining, or the like to include the water jacket 15, the spark plug holes 2A, . . . , the inlet ports 3A, 4A, . . . , the outlet ports 5A, 6A, . . . , the water jacket port 13, the cooling-water outlet 14, the cooling-water communication paths 12A to 12R, and others. The sand cores whereby forming the water jacket 15 are crushed after casting, and removed through the sand removing holes 16A, 16B, and 16C (an example of the "hole") and others. In the cylinder head 1 in this embodiment, the sand removing holes 16A, 16B, and 16C are provided nearly just above (in concentric relation with) the cooling-water communication paths 12D, 12E, and 12F respectively formed in the lower surface 1B.

<Cylinder Head Cleaning Device>

Figure 6:
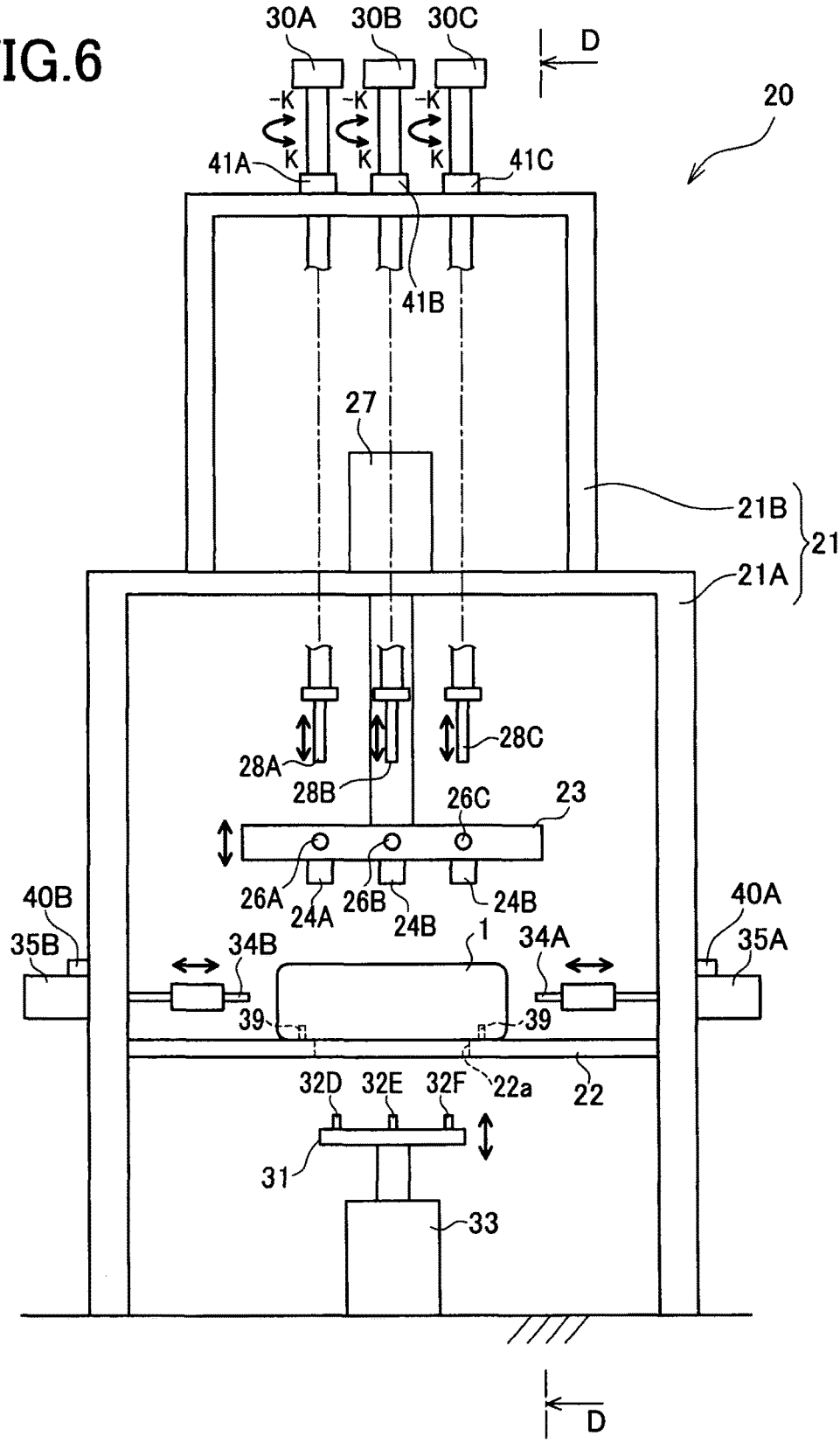
FIG. 6 is a schematic configuration view of a cleaning device for cleaning the cylinder head shown in FIG. 1.
Figure 7:
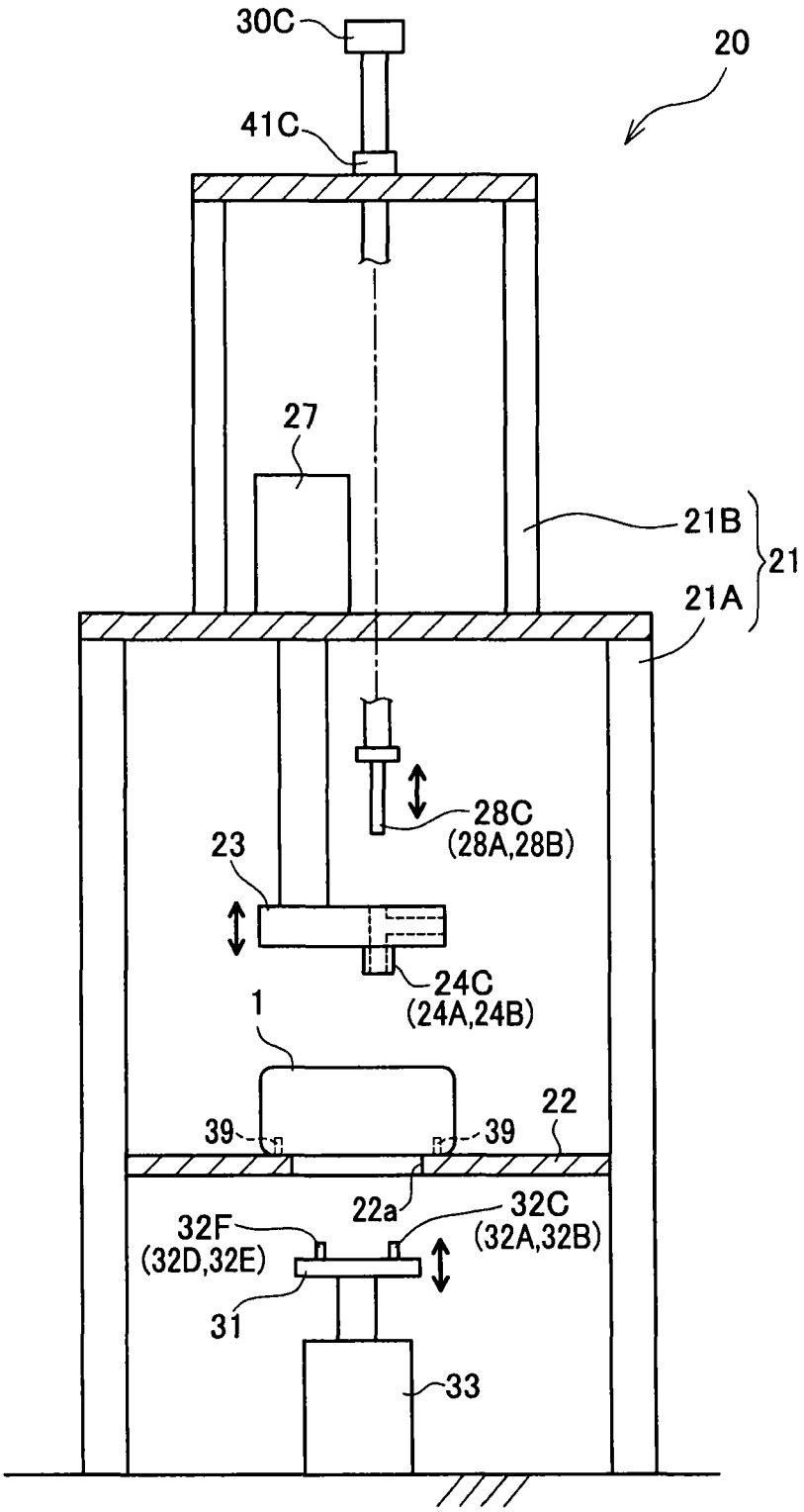
FIG. 7 is a sectional view taken along a line D-D in FIG. 6.
Figure 10:
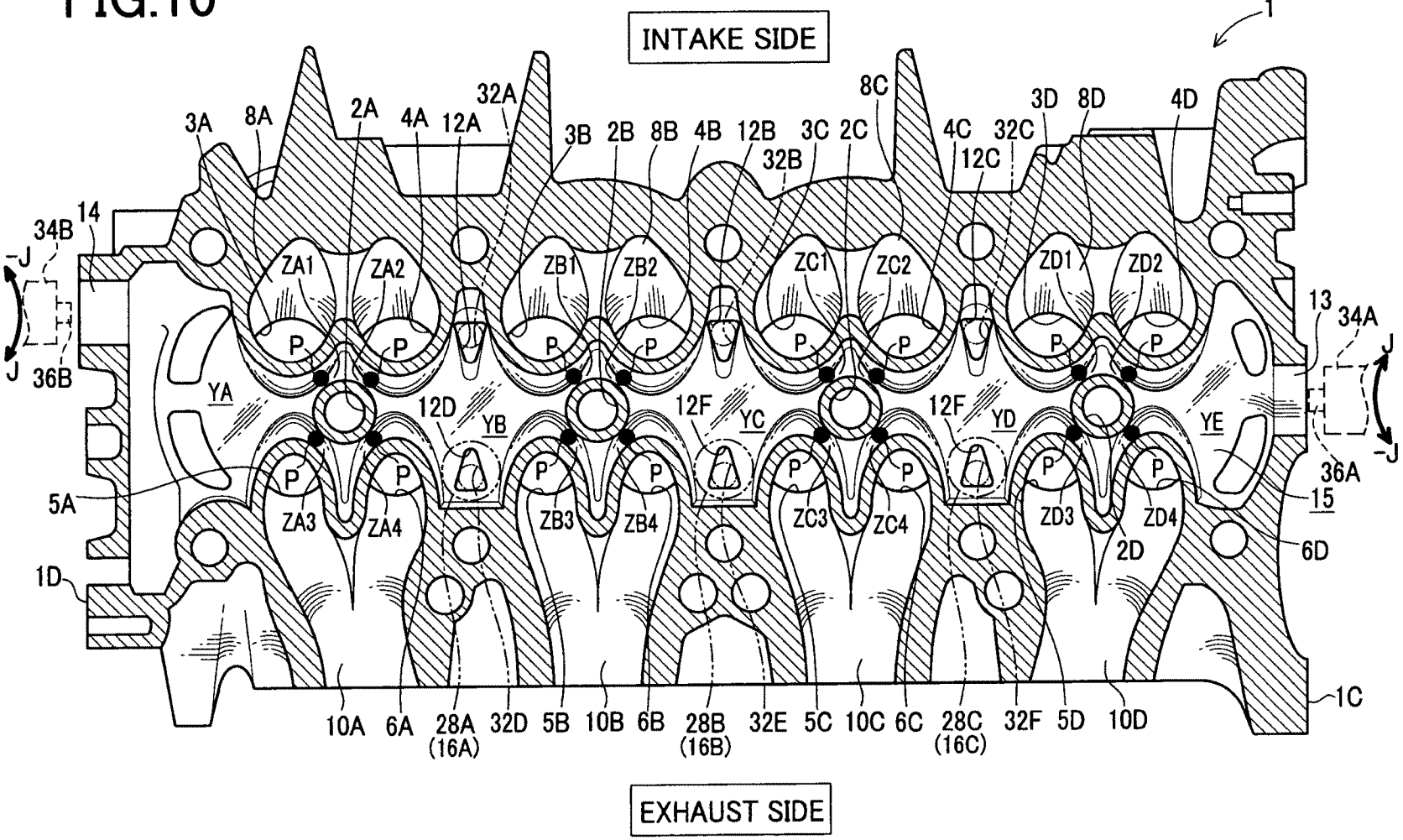
FIG. 10 is a view showing a positional relationship between the cylinder head of FIG. 1 and first to third nozzles of FIG. 6.
Figure 11:
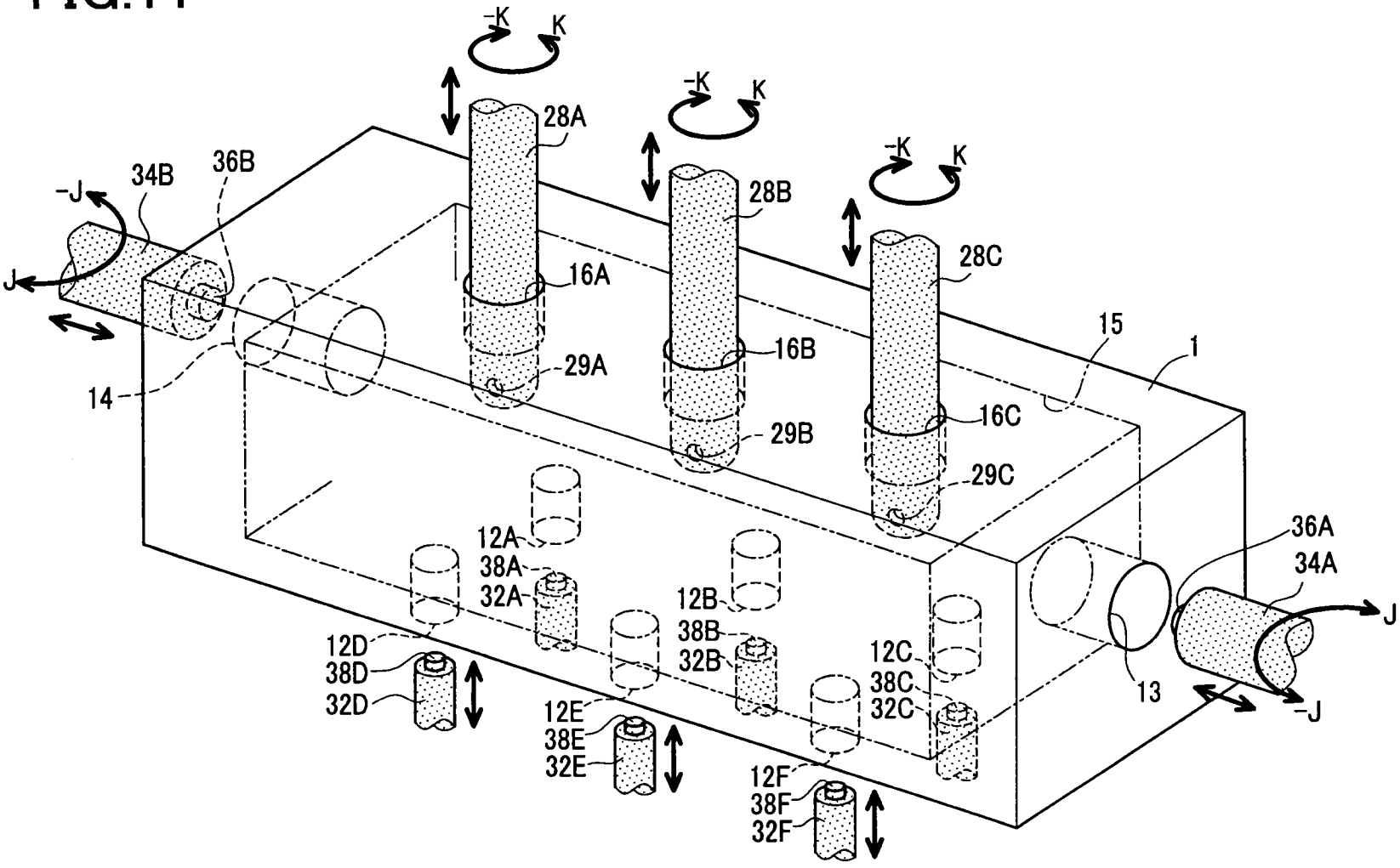
FIG. 11 is a view showing a positional relationship between the cylinder head of FIG. 1 and the first to third nozzles of FIG. 6.

FIG. 6 is a schematic configuration view of a cylinder head cleaning device 20 for cleaning the cylinder head 1 shown in FIG. 1. FIG. 7 is a sectional view taken along a line D-D in FIG. 6. FIGS. 10 and 11 are views showing a positional relationship between the cylinder head 1 of FIG. 1 and first to third cleaning nozzles 28A, 28B, 28C, 32A to 32F, 34A, and 34B shown in FIG. 6. It is to be noted that P in FIG. 10 represents foreign matters caught in the narrow space portions ZA1, ZA2, . . . .

The cylinder head cleaning device 20 includes an outer frame 21 having a lower frame part 21A and an upper frame part 21B as shown in FIGS. 6 and 7. In the lower frame part 21A, a table 22 on which the cylinder head 1 is to be put is installed horizontally with the ground. The cylinder head 1 is set on the table 22 so that the lower surface 1B is placed in contact with the table 22.

Under the table 22, a movable plate 31 is placed. This movable plate 31 is coupled to a hydraulic cylinder 33 to linearly reciprocate up and down in a vertical direction in the figure. The movable plate 31 is provided with six second cleaning nozzles 32A, 32B, 32C, 32D, 32E, and 32F in upright positions. As shown in FIGS. 10 and 11, the second cleaning nozzles 32A to 32F are arranged on the movable plate 31 in correspondence with the cooling-water communication paths 12A to 12F of the cylinder head 1. The second cleaning nozzles 32A to 32F each have such a columnar shape in section as to fit in the cooling-water communication paths 12A to 12F and are provided at respective tip ends with ejection ports 38A, 38B, and 38C for ejecting the cleaning liquid. The second cleaning nozzles 32A to 32F are connected to a control valve not shown and controlled to supply and stop the cleaning liquid.

As shown in FIGS. 6 and 7, the table 22 is provided with an opening 22*a* in which the movable plate 31 is inserted when the plate 31 is moved upward by the hydraulic cylinder 33. On the table 22, the positioning pins 39 are diagonally arranged in upright positions outside the opening 22*a*. When the positioning pins 39 are inserted in the positioning holes 9 of the cylinder head 1, the cylinder head 1 is fixed in position. The hydraulic cylinder 33 moves up the movable plate 31 up to a position to bring the second nozzles 32A to 32F near the openings of the cooling-water flow paths 12A to 12F of the cylinder head 1 positioned on the table 22.

As shown in FIGS. 6 and 7, the first cleaning nozzles 28A, 28B, and 28C are provided above the table 22. The first cleaning nozzles 28A, 28B, and 28C are arranged in correspondence with the sand removing holes 16A, 16B, and 16C each opening in the upper surface 1A of the cylinder head 1 positioned on the table 22, as shown in FIGS. 10 and 11. The first cleaning nozzles 28A, 28B, and 28C are formed, in peripheral surfaces near tip ends, with ejection ports 29A, 29B, and 29C respectively to eject the cleaning liquid, as shown in FIG. 11. The first cleaning nozzles 28A, 28B, and 28C are connected to the control valve not shown and controlled to supply and stop the cleaning liquid.

As shown FIGS. 6 and 7, linear motion units 41A, 41B, and 41C are fixed to the upper frame part 21B to linearly move the first cleaning nozzles 28A, 28B, and 28C up and down in a vertical direction in the figure. The first cleaning nozzles 28A, 28B, and 28C are coupled to drive motors 30A, 30B, and 30C respectively to rotate in a normal direction K and a reverse direction −K.

Above the table 22, a cleaning liquid discharge member 23 is disposed. A hydraulic cylinder 27 is fixed to the lower frame part 21A and connected to the cleaning liquid discharge member 23. The hydraulic cylinder 27 linearly moves the discharge member 23 up and down in the vertical direction in the figure relative to the table 22, thereby moving the discharge member 23 into or out of contact with the upper surface 1A of the cylinder head 1.

The cleaning liquid discharge member 23 has a thin rectangular parallelepiped plate shape having a larger base area than the cylinder head 1. The discharge member 23 is provided with insertion parts 24A, 24B, and 24C each protruding from a surface (a bottom surface) of the discharge member 23 which will contact with the cylinder head 1. The insertion parts 24A, 24B, and 24C each have such a shape (a columnar shape) fittable in the sand removing holes 16A, 16B, and 16C each opening in the upper surface 1A of the cylinder head 1. The insertion parts 24A, 24B, and 24C are arranged in the discharge member 23 in correspondence with the sand removing holes 16A, 16B, and 16C.

Figure 8:
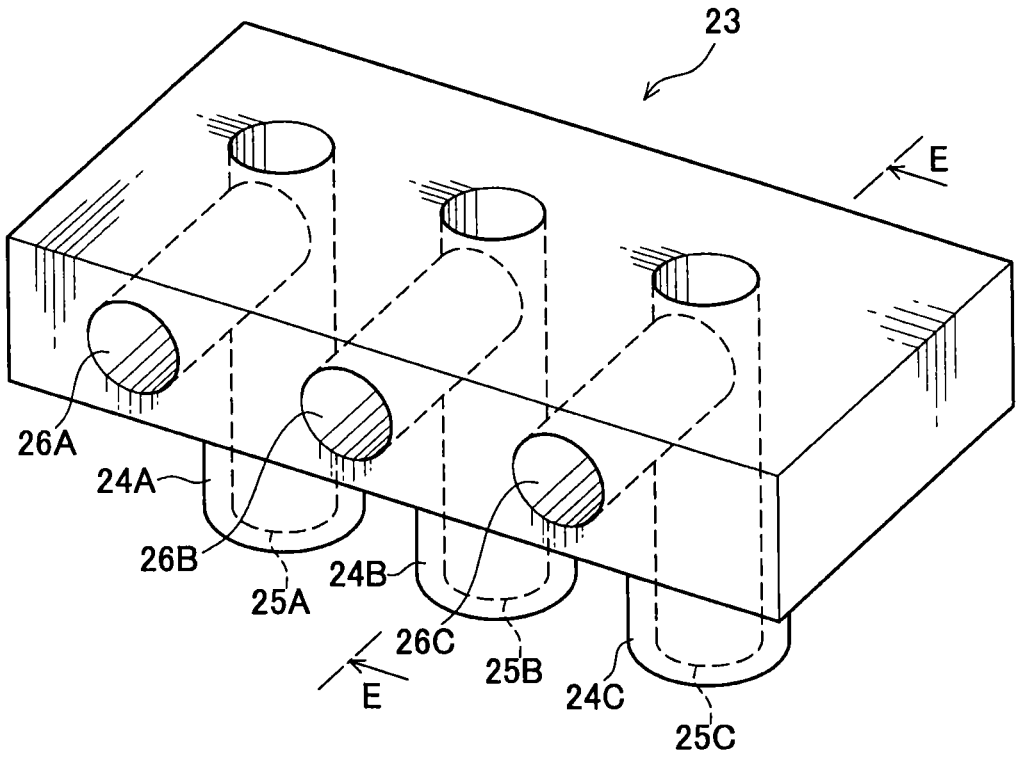
FIG. 8 is a perspective external view of a cleaning liquid discharge member shown in FIG. 6.
Figure 9:
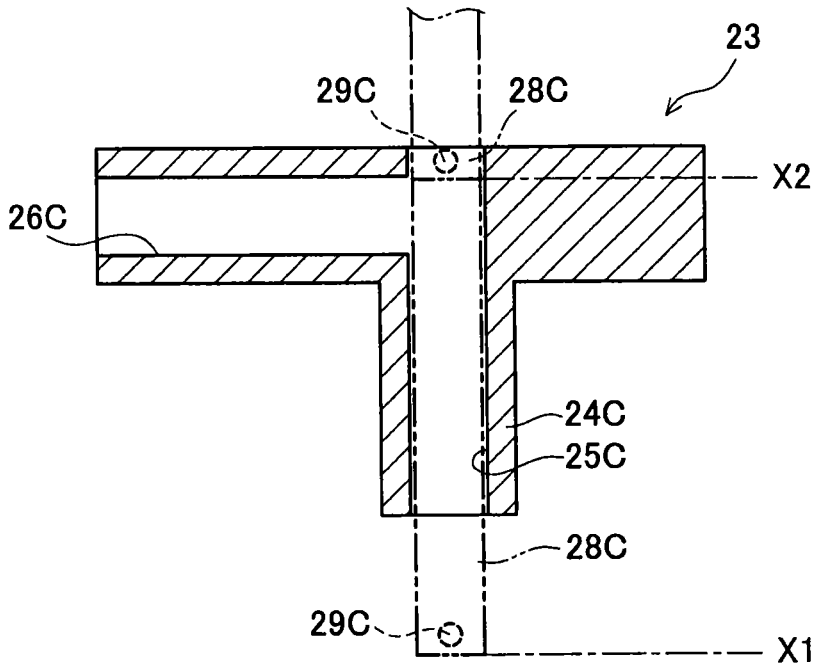
FIG. 9 is a sectional view taken along a line E-E in FIG. 8.

FIG. 8 is a perspective external view of the cleaning liquid discharge member 23 of FIG. 6. FIG. 9 is a sectional view taken along a line E-E in FIG. 8.

The discharge member 23 is formed with first flow paths 25A, 25B, and 25C and second flow paths 26A, 26B, and 26C. The first flow paths 25A, 25B, and 25C are formed through the discharge member 23 from the upper surface thereof to open in the lower surface through the insertion parts 24A, 24B, and 24C. On the other hand, the second flow paths 26A, 26B, and 26C are formed in the discharge member 23 to branch off from the first flow paths 25A, 25B, and 25C respectively and open in a side surface of the discharge member 23.

As shown in FIG. 9, in the first flow paths 25A, 25B, and 25C of the cleaning liquid discharge member 23, the first cleaning nozzles 28A, 28B, and 28C are to slidably be inserted. During a cleaning work of the cylinder head 1, the linear motion units 41A, 41B, and 41C (see FIGS. 6 and 7) are operated to stop the tip ends of the first cleaning nozzles 28A, 28B, and 28C in a "first stop position X1" to protrude from the lower surfaces of the insertion parts 24A, 24B, and 24C into the water jacket 15 or a "second stop position X2" to allow the second flow paths 26A, 26B, and 26C to branch off from the first flow paths 25A, 25B, and 25C, as shown in FIG. 9. It is to be noted that the linear motion units 41A, 41B, and 41C are operated to pull the first cleaning nozzles 28A, 28B, and 28C from the first flow paths 25A, 25B, and 25C and hold the first cleaning nozzles 28A, 28B, and 28C in a "retract position" (see FIGS. 6 and 7) excepting during cleaning of the cylinder head 1.

In the cylinder head cleaning device 20, as shown in FIG. 6, third cleaning nozzles 34A and 34B are placed on right and left sides of the cylinder head 1. The third cleaning nozzles 34A and 34B are connected to hydraulic cylinders 35A and 35B and swing units 40A and 40B each being fixed to the lower frame part 21A. The hydraulic cylinders 35A and 35B are operated to linearly reciprocally move the third nozzles 34A and 34B rightward and leftward in a horizontal direction in the figure relative to the table 22, thereby moving them close to or away from the water jacket port 13 and the cooling-water outlet 14 of the cylinder head 1. On the other hand, the swing units 40A and 40B are operated to swing the third cleaning nozzles 34A and 34B to change the orientations of the ejection ports 36A and 36B provided at tip ends of the third cleaning nozzles 34A and 34B as shown in FIG. 11. The third cleaning nozzles 34A and 34B are coupled to the control valve not shown and controlled to supply and stop the cleaning liquid.

<Cylinder Head Cleaning Method>

Figure 12:
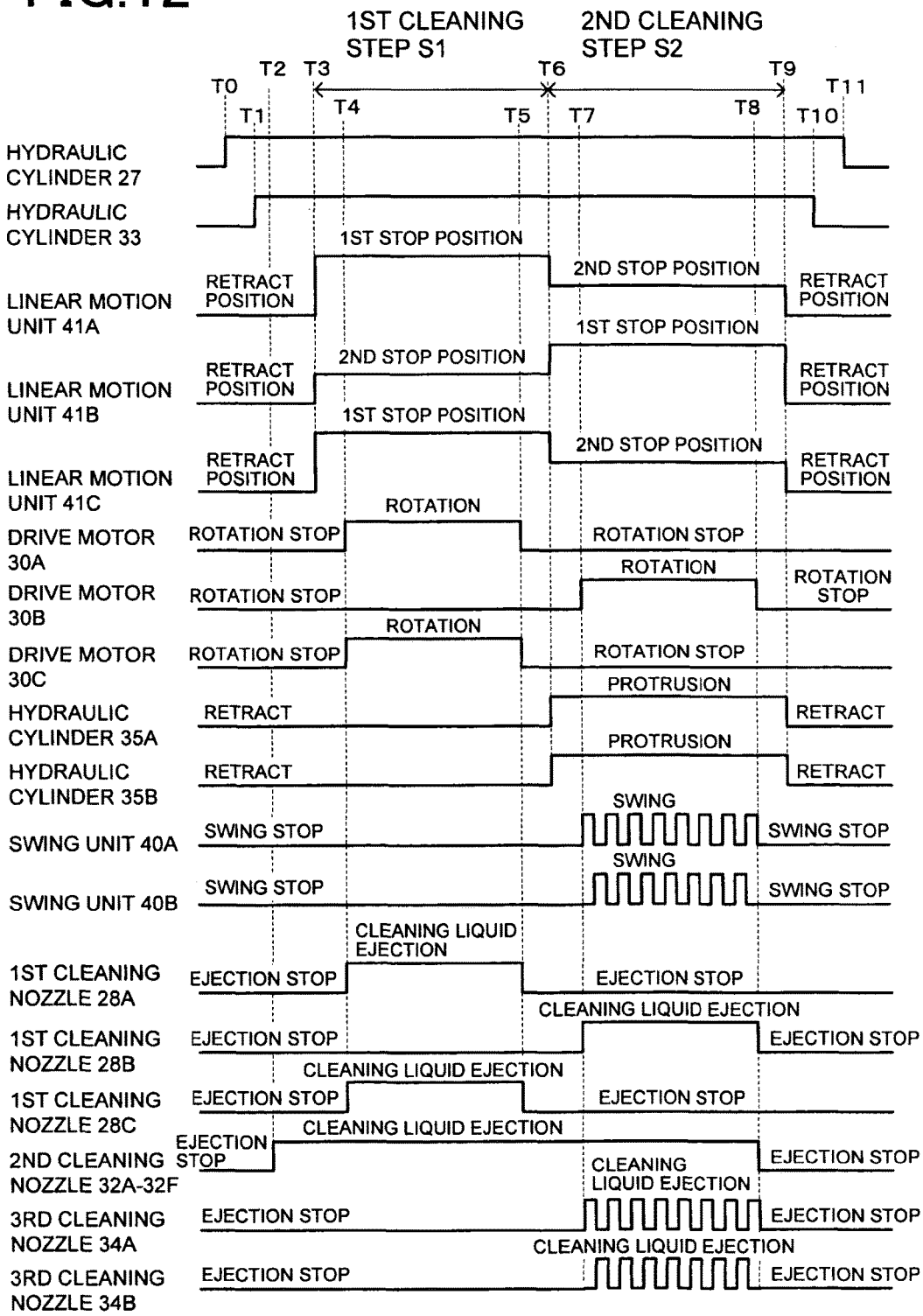
FIG. 12 is a timing chart schematically showing operations for cleaning a water jacket of the cylinder head of FIG. 1.
Figure 13:
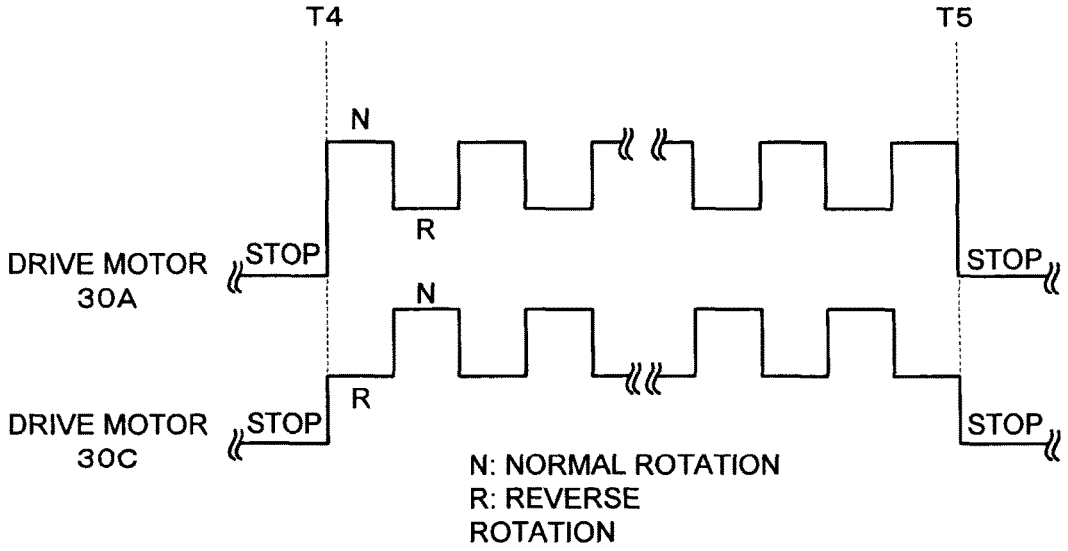
FIG. 13 is a timing chart showing in detail an operational relationship between drive motors in a first step.
Figure 14:
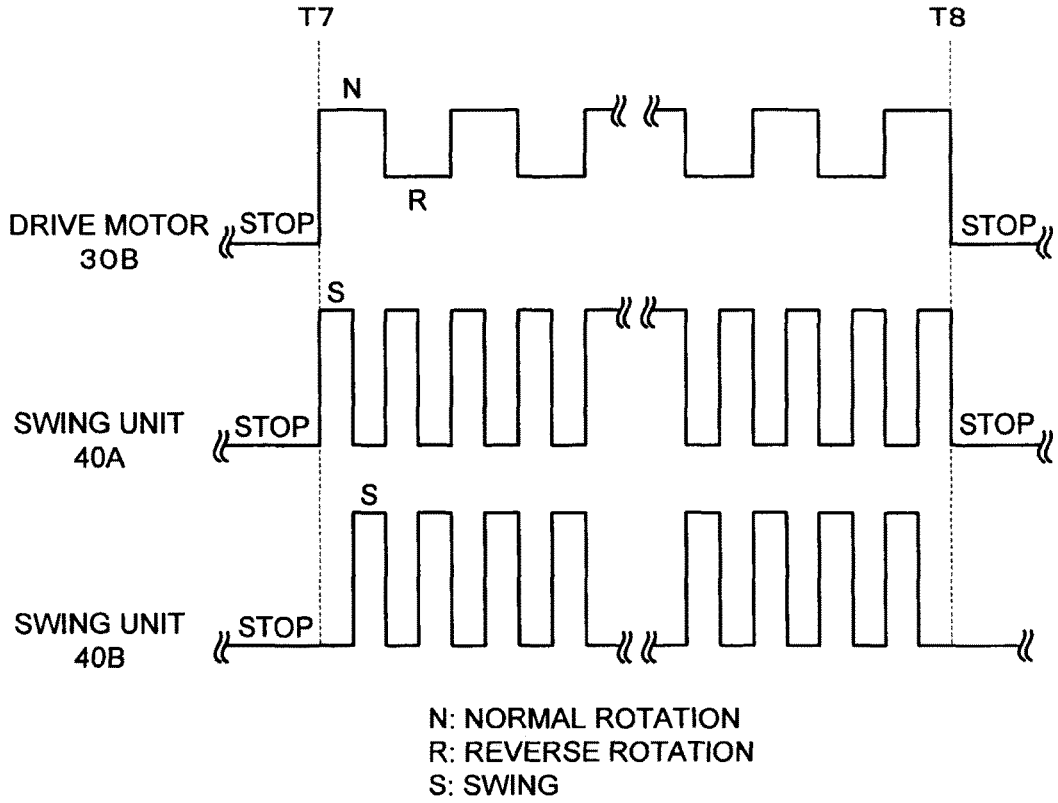
FIG. 14 is a timing chart showing an operational relationship between the drive motors and swing units in a second step.
Figure 15:
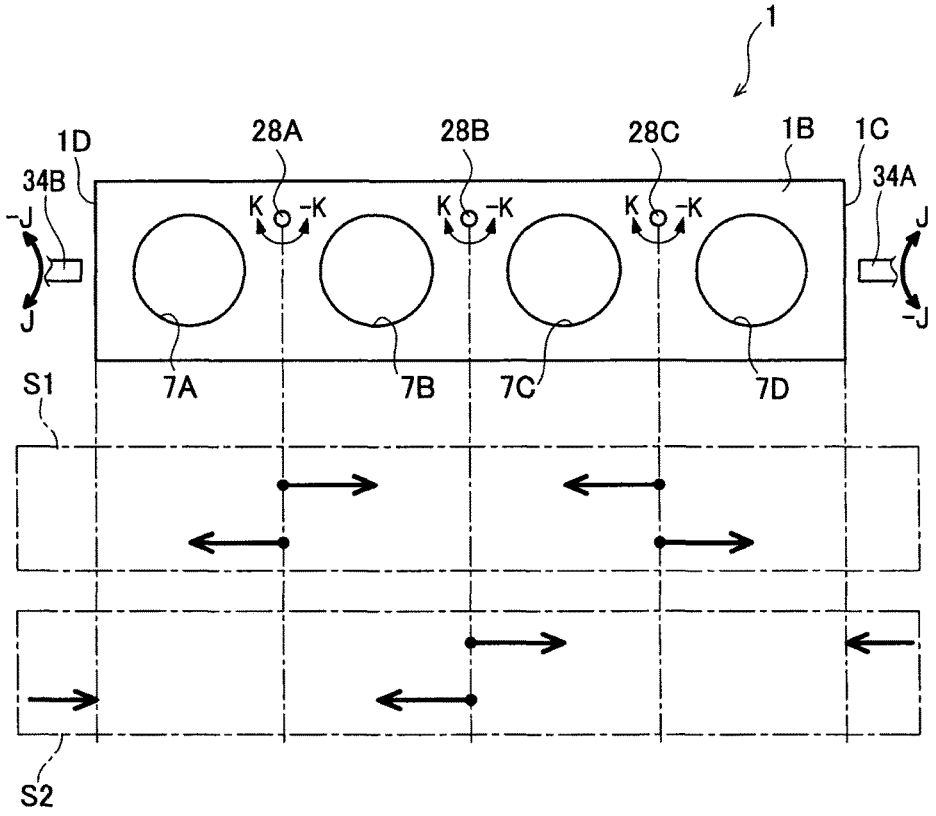
FIG. 15 is a conceptual view showing an example of a cleaning pattern for cleaning the cylinder head by the cleaning device shown in FIG. 6, including different columns per cleaning step to explain a cleaning method with arrows indicating directions of ejecting cleaning liquid.

The following explanation is given to a method of cleaning the cylinder head 1 by use of the cylinder head cleaning device 20. FIG. 12 is a timing chart schematically showing operations of cleaning the water jacket 15 of the cylinder head 1 shown in FIG. 1. FIG. 13 is a timing chart showing in detail an operational relationship in a first cleaning step S1. FIG. 14 is a timing chart showing in detail an operational relationship between drive motors and the swing units in a second cleaning step S2. FIG. 15 is a conceptual view showing an example of a cleaning pattern for cleaning the cylinder head 1 by the cylinder head cleaning device 20 of FIG. 6. In FIG. 15, S1 and S2 represent the first cleaning step S1 and the second cleaning step S2, arrows in the figure represent a cleaning liquid ejecting direction of the first cleaning nozzles 28A, 28B, and 28C in reversing positions and a cleaning water ejecting direction of the third cleaning nozzles 34A and 34B in coaxial positions with the water jacket port 13 and the cooling-water outlet 14.

As shown in FIG. 12, excepting during cleaning of the cylinder head 1, in the cylinder head cleaning device 20, the first cleaning nozzles 28A, 28B, and 28C are placed upward by being pulled away from the cleaning liquid discharge member 23 by the linear motion units 41A, 41B, and 41C, and then stopped in the retract positions. The hydraulic cylinder 33 moves the movable plate 31 downward to hold the second cleaning nozzles 32A to 32F below the table 22. Furthermore, the hydraulic cylinders 35A and 35B moves the third cleaning nozzles 34A and 34B away from the cylinder head 1.

Then, in the cylinder head cleaning device 20, the cylinder head 1 is set on the table 22 so that the positioning pins 39 of the table 22 are inserted in the positioning holes 9 of the cylinder head 1. Thus, the cylinder head 1 is fixed in position on the table 22.

At T0 in FIG. 12, the hydraulic cylinder 27 moves the cleaning liquid discharge member 23 downward, thereby bringing the insertion parts 24A, 24B, and 24C of the discharge member 23 into connection with the sand removing holes 16A, 16B, and 16C of the cylinder head 1. Thus, the discharge member 23 presses the cylinder head 1 against the table 22 to prevent wobbling of the cylinder head 1.

At T1 in FIG. 12, in the cylinder head cleaning device 20, the hydraulic cylinder 33 moves the movable plate 31 upward, thereby placing the second cleaning nozzles 32A to 32F close to the cooling-water communication paths 12A to 12F of the cylinder head 1 respectively.

At T2 in FIG. 12, the cleaning liquid is ejected at low pressure (0.15 MPa) from the second cleaning nozzles 32A to 32F so that the cleaning liquid is stored up to about half of the water jacket 15 (a depth of about 30 mm from the lower surface 1A of the cylinder head 1) to create a similar condition in the water jacket 15 to an in-water state (hereinafter, a "pseudo in-water state") as indicated by a broken line in the water jacket port 13 in FIG. 3. It is to be noted that the cleaning liquid is continuously supplied from the second cleaning nozzles 32A to 32F until the end of cleaning of the cylinder head 1. During cleaning of the cylinder head 1, the cleaning liquid of a prescribed quantity is stored in the water jacket 15.

Thereafter, the cylinder head cleaning device 20 starts the first cleaning step S1.

Specifically, at T3 in FIG. 12, the linear motion units 41A, 41B, and 41C move the first cleaning nozzles 28A, 28B, and 28C downward. In the first cleaning step S1, for example, the sand removing holes 16A and 16C are selected for execution of cleaning. In this case, the linear motion units 41A and 41C stop the first cleaning nozzles 28A and 28C in the first stop position X1 and insert the tip ends of the first cleaning nozzles 28A and 28C into the water jacket 15 (see FIGS. 9 and 11). At that time, the drive motors 30A and 30C are stopped so that the ejection ports 29A and 29C of the first cleaning nozzles 28A and 28C face each other (the positions of the first cleaning nozzles 28A and 28C are hereinafter referred to as "first reversing positions"). On the other hand, the linear motion unit 41B stops the first cleaning nozzle 28B in the second stop position X2 so that the nozzle 28B does not enter the water jacket 15 and closes the upper opening of the first flow path 25B (see FIG. 9).

Thereafter, at T4 in FIG. 12, the drive motors 30A and 30C are rotated to rotate the first cleaning nozzles 28A and 28C. The first cleaning nozzles 28A and 28C continue to eject the cleaning liquid at high pressure (e.g., 10 to 30 MPa) while the drive motors 30A and 30C are rotated.

To be concrete, as shown in FIGS. 13 and 15, the drive motors 30A and 30C are driven to rotate the first cleaning nozzles 28A and 28C by 180° in the normal direction K and the reverse direction −K respectively at the same rotating speed from the first reversing positions, orienting the ejection ports 29A and 29C in reverse directions and then rotated back respectively (the positions from which the first cleaning nozzles 28A and 28C are reversely rotated are hereinafter referred to as "second reversing positions").

The first cleaning nozzles 28A and 28C eject the cleaning liquid while rotating, thereby consecutively changing the space portions to which the cleaning liquid is ejected. For instance, as shown in FIGS. 13 and 15, the first cleaning nozzles 28A and 28C eject the cleaning liquid toward the narrow space portions ZB3, ZB1, ZC4, ZC2 shown in FIG. 10 during rotation in the normal direction K and the reverse direction −K respectively from the first reversing positions to change the orientations of the ejection ports 29A and 29C by about 90°. The cleaning liquid jets ejected from the first cleaning nozzles 28A and 28C flow through the narrow space portions ZB3, ZB1, ZC4, ZC2 and further the narrow space portions ZB4, ZB2, ZC3, ZC1 and then flow in opposite directions into the large space portion YC to collide each other therein. Thus, the cleaning liquid spouts from the sand removing hole 16B communicating with the large space portion YC.

Herein, the sand removing hole 16B, in which the insertion part 24B of the cleaning liquid discharge member 23 is fitted, communicates with the first flow path 25B. The upper opening of the first flow path 25B is blocked by the first cleaning nozzle 28B and hence the cleaning liquid spouting from the sand removing hole 16B is caused to flow from the first flow path 25B to the second flow path 26B, and then be discharged together with the foreign matters P toward the side of the cylinder head 1. The discharge member 23 is larger than the cylinder head 1 and located so that the opening of the second flow path 26B is positioned on the outer side of the side surface of the cylinder head 1. Thus, the discharge member 23 enables discharge of the cleaning liquid containing the foreign matters P without splashing the cleaning liquid on the cylinder head 1.

As shown in FIG. 15, the first cleaning nozzles 28A and 28C eject the cleaning liquid toward the narrow space portions ZA2, ZA4, ZD1, and ZD3 shown in FIG. 10 during rotation from the positions displaced by about 90° from the first reversing positions to the second reversing positions to further change the orientation of each ejection port 29A and 29C by about 90° in the normal direction K. The cleaning liquid jets ejected from the first cleaning nozzles 28A and 28C flow through the narrow space portions ZA2, ZA4, ZD1, and ZD3 and further the narrow space portions ZA1, ZA3, ZD2, and ZD4 and flow into the large space portions YA and YE respectively and then are discharged from the cooling-water outlet 14 and the water jacket port 13 respectively. The water jacket port 13 and the cooling-water outlet 14 are open in the side surfaces 1C and 1D of the cylinder head 1 respectively. Accordingly, the cleaning liquid containing the foreign matters P discharged from the water jacket port 13 and the cooling-water outlet 14 does not enter the water jacket 15 again.

The first cleaning nozzles 28A and 28C rotated in the normal direction K and the reverse direction −K to the second reversing positions are reversely rotated to eject the cleaning liquid toward the narrow space portions ZA4, ZA2, ZB1, ZB3, ZD3, ZD1, ZC2, and ZC4 in the reverse procedure to the above. The first cleaning nozzles 28A and 28C rotated in the reverse direction −K and the normal direction K to the first reversing positions are reversely rotated therefrom to eject the cleaning liquid toward the narrow space portions ZB3, ZB1, ZA2, ZA4, ZC4, ZC2, ZD1, and ZD3 in the same procedure to the above. In this way, the first cleaning nozzles 28A and 28C sequentially change the space portions to which the cleaning liquid is ejected and the holes 16A, 13, and 14 through which the cleaning liquid is discharged and eject the cleaning liquid directly at the foreign matters P caught in the narrow space portions ZA2, ZA4, ZB1, ZB3, ZC2, ZC4, ZD1, and ZD3, thereby sweeping the foreign matters P from the narrow space portions ZA2, ZA4, ZB1, ZB3, ZC2, ZC4, ZD1, and ZD3 to the large space portions YA, YC, an YE and discharging the foreign matters P out of the cylinder head 1.

After the drive motors 30A and 30C rotate the first cleaning nozzles 28A and 28C by a prescribed number of rotations between the first and second reversing positions, at T5 in FIG. 12, the first cleaning nozzles 28A and 28C are stopped from ejecting the cleaning liquid. The first cleaning step S1 is thus terminated.

The cylinder head cleaning device 20 subsequently starts a second cleaning step S2.

Specifically, at T6 in FIG. 12, the linear motion units 41A and 41C move the first cleaning nozzles 28A and 28C upward from the first stop position in which the nozzles 28A and 28C are inserted in the sand removing holes 16A and 16C selected in the first cleaning step S1 to the second stop position. The linear motion unit 41B moves the first cleaning nozzle 28B downward from the second stop position to the first stop position. Accordingly, the first cleaning nozzle 28B is inserted in the sand removing hole 16B not selected in the first cleaning step S1. At that time, the first cleaning nozzle 28B is placed in the sand removing hole 16B to orient the ejection port 29B to face the third cleaning nozzle 34A (this position of the first cleaning nozzle 28B is hereinafter referred to as a "third reversing position"). The hydraulic cylinders 35A and 35B move the third cleaning nozzles 34A and 34B close to the cylinder head 1, thereby bringing the ejection ports 36A and 36B of the third cleaning nozzles 34A and 34B close to the water jacket port 13 and the cooling-water outlet 14 respectively.

At T7 in FIG. 12, the drive motor 30B is rotated. While the first cleaning nozzle 28B is rotated by the drive motor 30B, the nozzle 28B continuously ejects the cleaning liquid at high pressure (e.g., 10 to 30 MPa) through the ejection port 29B. While the first cleaning nozzle 28C is rotated by the drive motor 30B, the third cleaning nozzles 34A and 34B intermittently eject the cleaning liquid at high pressure (e.g., 10 to 30 MPa) through the ejection ports 36A and 36B. The swing units 40A and 40B swing the third cleaning nozzles 34A and 34B respectively in sync with the ejection timing of the cleaning liquid by the third cleaning nozzles 34A and 34B.

Specifically, as shown in FIGS. 14 and 15, the drive motor 30B rotates the first cleaning nozzle 28B by 180° from the third reversing position in the normal direction K to orient the ejection port 29B to face the third cleaning nozzle 34B and then reversely rotates the first cleaning nozzle 28B. This reversing position of the first cleaning nozzle 28B is hereinafter referred to as a "fourth reversing position". The swing unit 40A swings the third cleaning nozzle 34A until the drive motor 30B rotates the first cleaning nozzle 28B by about 90° from the third reversing position in the normal direction K. On the other hand, the swing unit 40B swings the third cleaning nozzle 34B until the drive motor 30B rotates the first cleaning nozzle 28B to the fourth reversing position from a position about 90° displaced from the third reversing position.

For instance, as shown in FIGS. 14 and 15, the first cleaning nozzle 28B ejects the cleaning liquid toward the narrow space portions ZC3 and ZC1 shown in FIG. 10 while the nozzle 28B is rotated by about 90° from the third reversing position in the normal direction K to change the orientation of the ejection port 29B by about 90°. Correspondingly, while the third cleaning nozzle 34A is swung by the swing unit 40A in a direction J in the figure to swing in reversed phase to the rotation direction K of the first cleaning nozzle 28B, the third cleaning nozzle 34A ejects the cleaning liquid toward the narrow space portions ZD4 and ZD2 shown in FIG. 10. The cleaning liquid jets ejected from the first cleaning nozzle 28B and the third cleaning nozzle 34A flow through the narrow space portions ZC3, ZC1, ZD4, and ZD2 and further the narrow space portions ZC4, ZC2, ZD3, and ZD1 and flow in opposite directions into the large space portion YD and collide with each other therein, and spout from the sand removing hole 16C communicating with the large space portion YD. The cleaning liquid spouting from the sand removing hole 16C is discharged out of the cylinder head 1 through the cleaning liquid discharge member 23. This method of discharging the cleaning liquid is similar to the aforementioned method of discharging the cleaning liquid from the sand removing hole 16B and thus the details thereof are not repeated herein.

As shown in FIG. 15, the first cleaning nozzle 28B ejects the cleaning liquid toward the narrow space portions ZB2 and ZB4 shown in FIG. 10 while the nozzle 28B is rotated to the fourth reversing position from the position displaced by about 90° from the third reversing position to further change the orientation of the ejection port 29B by about 90° in the normal direction K. When the first cleaning nozzle 28B is rotated beyond the position displaced 90° from the third reversing position, the third cleaning nozzle 34A is stopped from ejecting the cleaning liquid and also stopped from swinging by the swing unit 40A. On the other hand, the third cleaning nozzle 34B ejects the cleaning liquid toward the narrow space portions ZA1 and ZA3 shown in FIG. 10 while the nozzle 34B is swung in the direction J in the figure to swing in reversed phase to the first cleaning nozzle 28B by the swing unit 40B. The cleaning liquid jets ejected from the first cleaning nozzle 28B and the third cleaning nozzle 34B flow through the narrow space portions ZB2, ZB4, ZA1, and ZA3 and further the narrow space portions ZB1, ZB3, ZA2, and ZA4 and flow in opposite directions into the large space portion YB and collide with each other therein, and then spout from the sand removing hole 16A communicating with the large space portion YB. The cleaning liquid spouting from the sand removing hole 16A is discharged out of the cylinder head 1 through the cleaning liquid discharge member 23. This method of discharging the cleaning liquid is similar to the aforementioned method of discharging the cleaning liquid from the sand removing hole 16B and thus the details thereof are not repeated herein.

The first cleaning nozzle 28B rotated in the normal direction K to the fourth reversing position is reversely rotated therefrom to eject the cleaning liquid toward the narrow space portions ZB4, ZB2, ZC1, and ZC3 in the reverse procedure to the above. The third cleaning nozzles 34A and 34B are swung in a direction −J according to the rotation angle of the first cleaning nozzle 28B so as to swing in reversed phase to the rotation direction −K of the first cleaning nozzle 28B. The nozzles 34A and 34B then eject the cleaning liquid toward the narrow space portions ZA3, ZA1, ZD2, and ZD4 respectively. The first cleaning nozzle 28B rotated in the reverse direction −K to the third reversing position is reversely rotated therefrom to eject the cleaning liquid toward the narrow space portions ZC3, ZC1, ZB2, and ZB4 in the same procedure as above. Correspondingly, the third cleaning nozzles 34A and 34B eject the cleaning liquid while being swung in the direction J in the same procedure to the above. As above, the first cleaning nozzle 28B and the third cleaning nozzles 34A and 34B eject the cleaning liquid directly at the foreign matters P caught in the narrow space portions ZA1, ZA3, ZB2, ZB4, ZC1, ZC3, ZD2, and ZD4 by sequentially changing the space portions to which the cleaning liquid is ejected and the holes 16B and 16C through which the cleaning liquid is discharged, thereby causing turbulent flows in the water jacket 15, to sweep the foreign matters P from the narrow space portions ZA1, ZA3, ZB2, ZB4, ZC1, ZC3, ZD2, and ZD4 to the large space portions YB and YD to discharge the foreign matters P out of the cylinder head 1.

After the drive motor 30B rotates the first cleaning nozzle 28B in a prescribed number of rotations in the normal direction K and the reverse direction −K, at T8 in FIG. 12, the first to third cleaning nozzles 28A, 28B, 28C, 32A to 32F, 34A, and 34B are stopped from ejecting the cleaning liquid. At the same time as rotation stop of the drive motor 30B, the swing units 40A and 40B stop swing the third cleaning nozzles 34A and 34B.

Thereafter, at T9 in FIG. 12, the linear motion units 41A, 41B, and 41C move the first cleaning nozzles 28A, 28B, and 28C upward to respective retract positions. The hydraulic cylinders 35A and 35B retract the third cleaning nozzles 34A and 34B back to separate from the cylinder head 1. The second cleaning step S2 is terminated.

At T10 in FIG. 12, the hydraulic cylinder 33 moves the movable plate 32 downward to separate the second cleaning nozzles 32A to 32F from the cylinder head 1.

At T11 in FIG. 12, the hydraulic cylinder 27 moves the cleaning liquid discharge member 23 upward to disengage the insertion parts 24A, 24B, and 24C from the sand removing holes 16A, 16B, and 16C.

Then, the cylinder head 1 is lifted up to pull the positioning pins 39 from the positioning holes 9 and conveyed to a next work section.

The cleaned cylinder head 1 is moved to an inspection station for foreign matters and subjected to a visual inspection by a person to check whether the foreign matters P remain in the water jacket 15 and others.

<Fluid Analysis Simulation>

Fluid analysis simulation conducted by the inventors is explained below.

The inventors simulated the flow velocity and the flow direction of the cleaning liquid flowing in the water jacket 15 by use of a fluid analysis software about a case where the cleaning liquid is ejected at 10 to 30 MPa from the first cleaning nozzles 28A and 28C toward the spark plug holes 2B and 2C side to clean the cylinder head 1 without supplying the cleaning liquid from the second cleaning nozzles 32A, 32B, 32C, 32D, 32E, and 32F to the water jacket 15 (hereinafter, referred to as "in-air cleaning" in the present description) and a case where the cleaning liquid is ejected at 10 to 30 MPa from the first cleaning nozzles 28A and 28C toward the spark plug holes 2B and 2C side to clean the cylinder head 1 while supplying the cleaning liquid at 0.15 MPa from the second cleaning nozzles 32A, 32B, 32C, 32D, 32E, and 32F to the water jacket 15 (hereinafter, referred to as "pseudo in-water cleaning" in the present description). Results of this simulation are shown in FIGS. 16 to 19. It is to be noted that FIGS. 16 to 19 show the flow velocity and the flow direction of the cleaning liquid in the water jacket 15 and show the shape which does not coincide with the shape of cross section shown in FIG. 4 for showing the analysis results.

Figure 16:
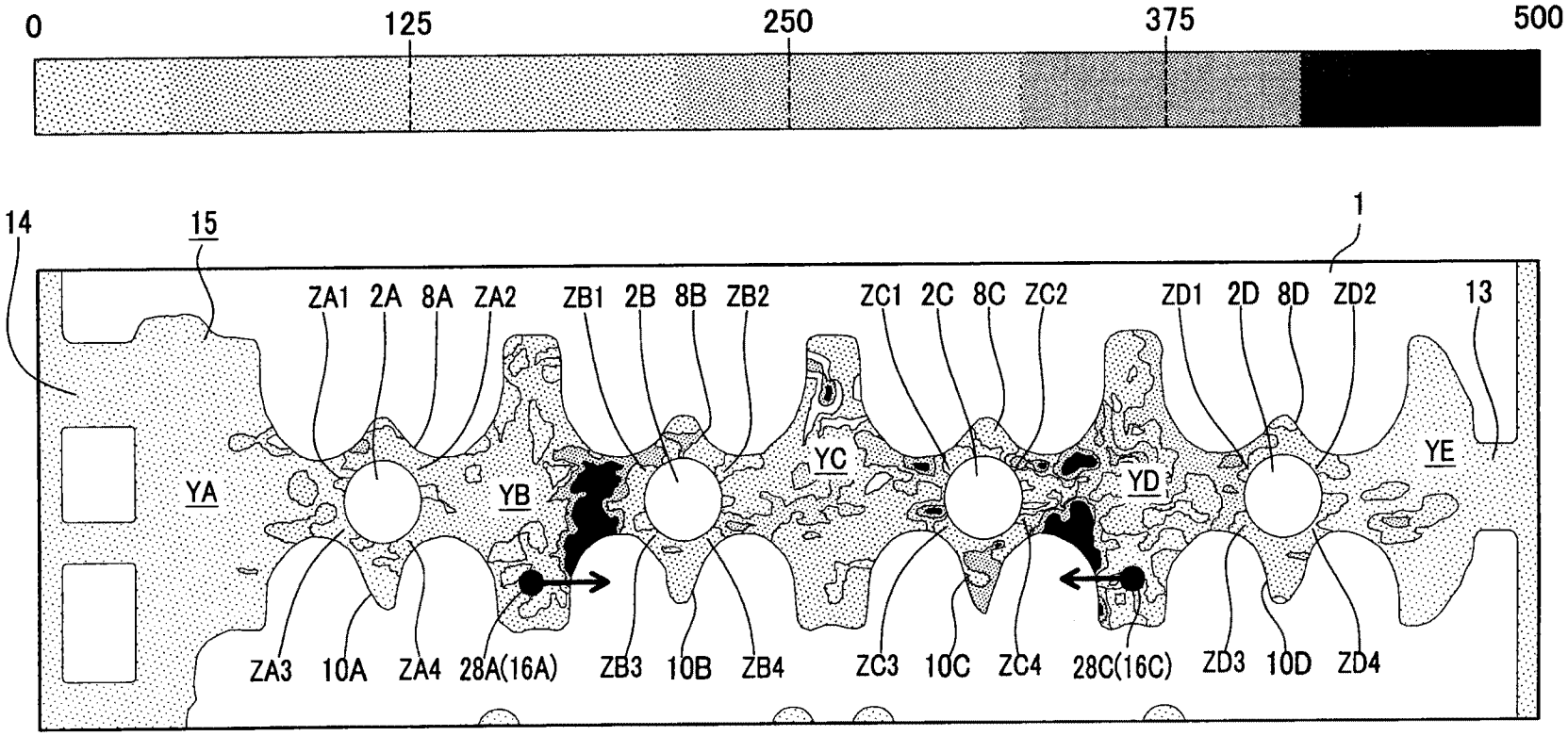
FIG. 16 is a view showing a simulation result of a flow velocity of cleaning liquid in the case of in-air cleaning of the cylinder head of FIG. 1.

FIG. 16 is a view showing a result of simulating the flow velocity of the cleaning liquid in the case where the cylinder head 1 of FIG. 1 is subjected to the in-air cleaning.

In the cylinder head 1 subjected to the in-air cleaning, the cleaning liquid flows at a flow velocity of about 2 m/sec in the narrow space portions ZB1, ZB3, ZC2, and ZC4 and the large space portion YC. In particular, the cleaning liquid is ejected at initial velocity to flow at a flow velocity of 4 m/sec or more in the narrow space portions ZB1, ZB3, ZC2, and ZC4. Near the sand removing hole 16B through which the cleaning liquid is discharged, a flow velocity of about 1 m/sec is ensured.

Figure 17:
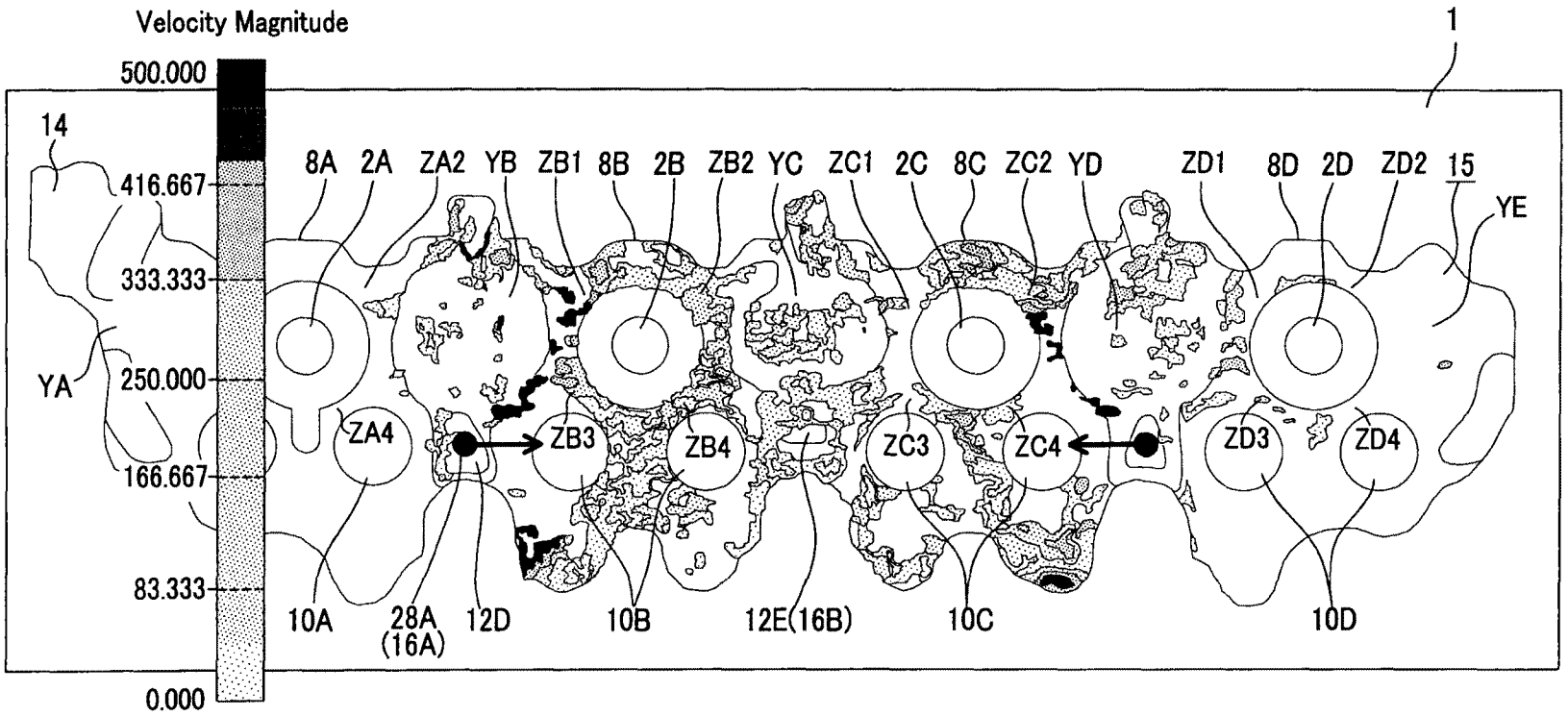
FIG. 17 is a view showing a simulation result of a flow distribution of cleaning liquid in the case of the in-air cleaning of the cylinder head of FIG. 1.

FIG. 17 is a view showing a result of simulating the flow distribution of the cleaning liquid in the case where the cylinder head 1 of FIG. 1 is subjected to the in-air cleaning.

In the cylinder head 1 subjected to the in-air cleaning, the flow of the cleaning liquid is created in the water jacket 15 at about 2 L/min, flowing from the sand removing holes 16A and 16C in which the first cleaning nozzles 28A and 28C are inserted toward the sand removing hole 16B of the large space portion YC.

Accordingly, when the cylinder head 1 is subjected to the in-air cleaning, the cleaning liquid jets ejected in opposite directions by the first cleaning nozzles 28A and 28C toward the narrow space portions ZB1, ZB3, ZC2, and ZC4 flow together in the large space portion YC, forming a flow to be discharged from the sand-removing hole 16B.

Figure 18:
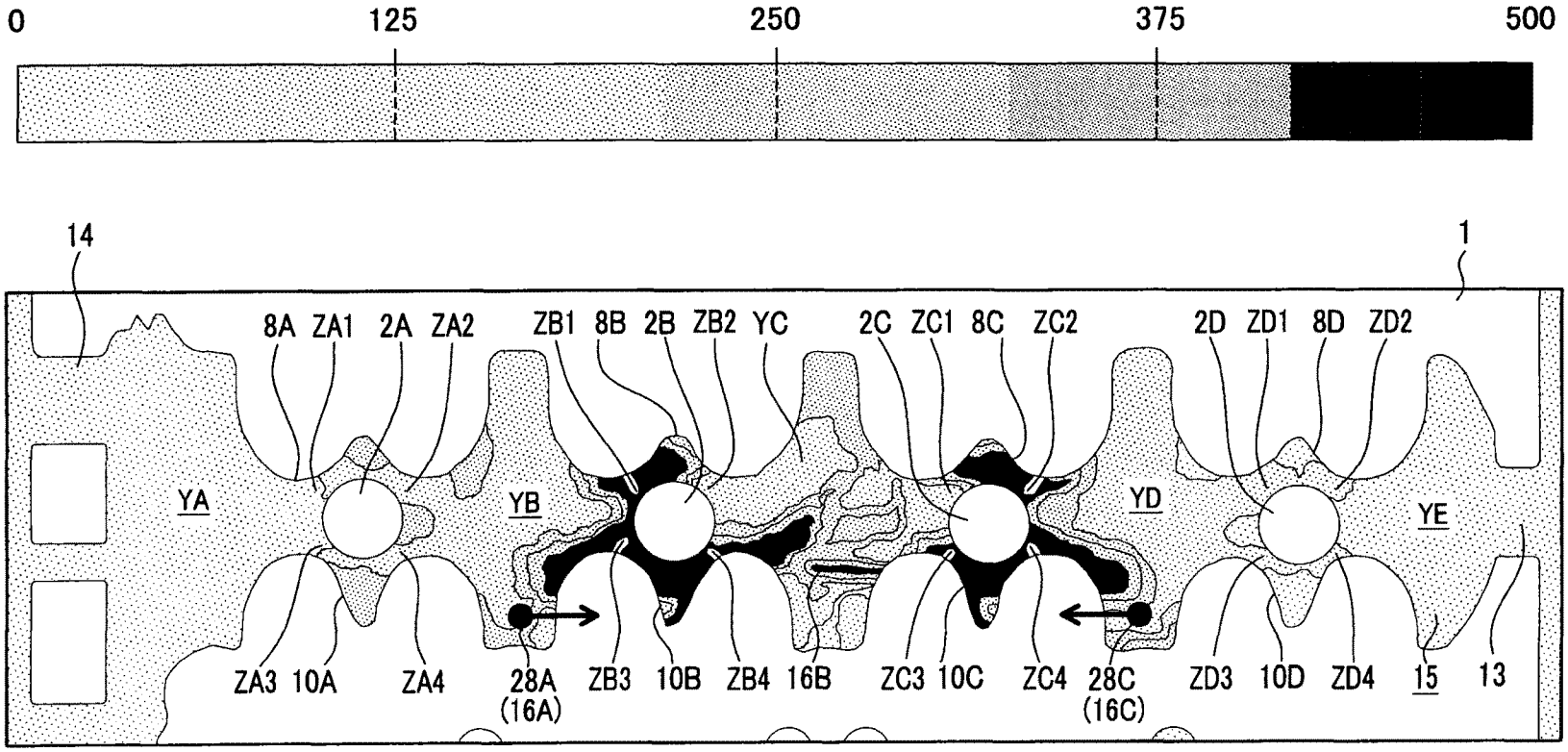
FIG. 18 is a view showing a simulation result of a flow velocity of cleaning liquid in the case of pseudo in-water cleaning of the cylinder head of FIG. 1.

FIG. 18 is a view showing a result of simulating the flow velocity of the cleaning liquid in the case where the cylinder head 1 of FIG. 1 is subjected to the pseudo in-water cleaning.

In the cylinder head 1 subjected to the pseudo in-water cleaning, the cleaning liquid flows at a flow velocity of 4 m/sec or more in the narrow space portions ZB2, ZB4, ZC1, and ZC3 as well as in the narrow space portions ZB1, ZB3, ZC2, and ZC4. Furthermore, the cleaning liquid flows at a flow velocity of 4 to 5 m/sec or more near the sand removing hole 16B in the large space portion YC and a flow velocity of 2.5 m/sec or more in the entire large space portion.

Figure 19:
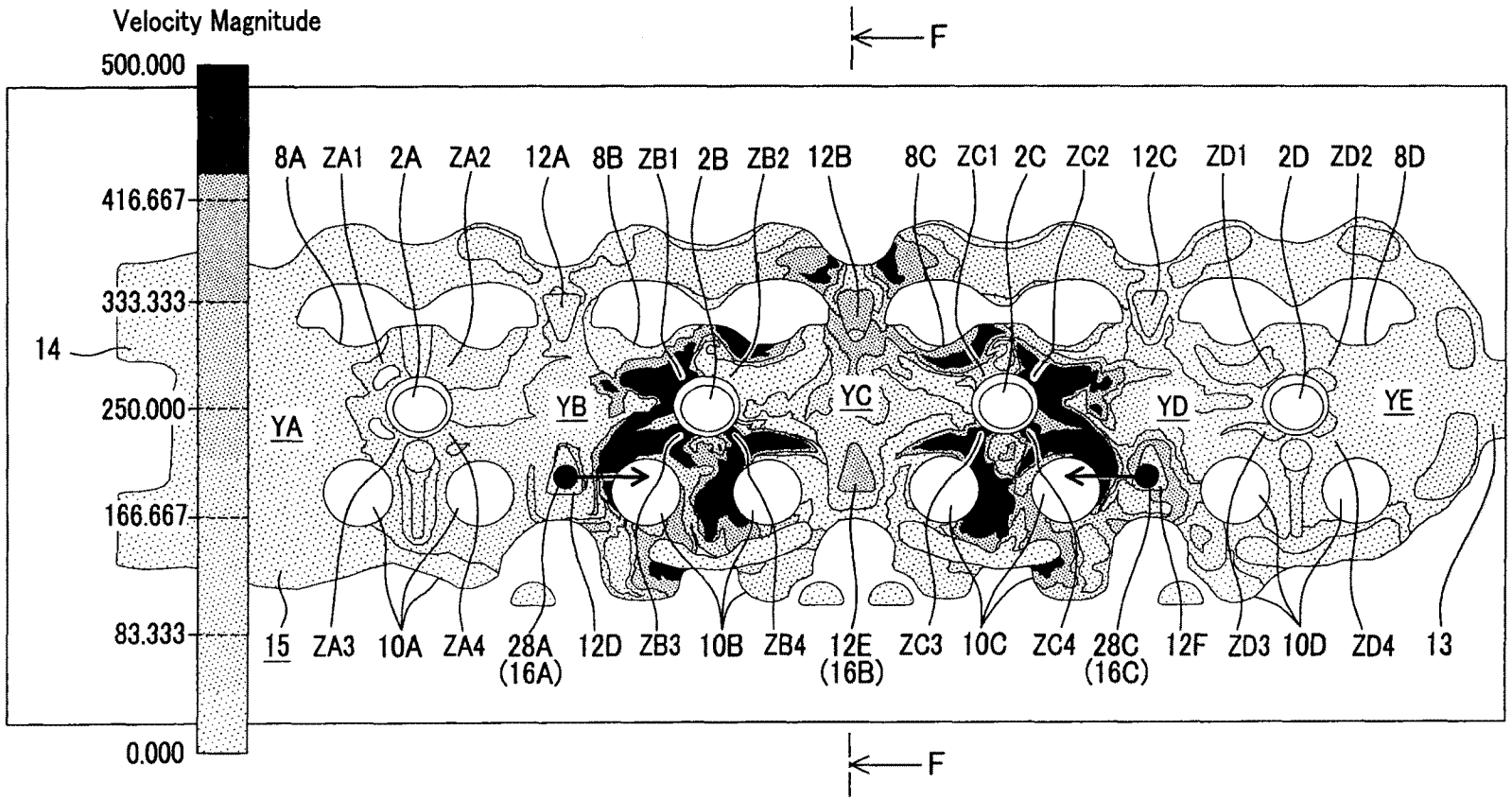
FIG. 19 is a is a view showing a simulation result of a flow distribution of cleaning liquid in the case of the pseudo in-water cleaning of the cylinder head of FIG. 1.
Figure 20:
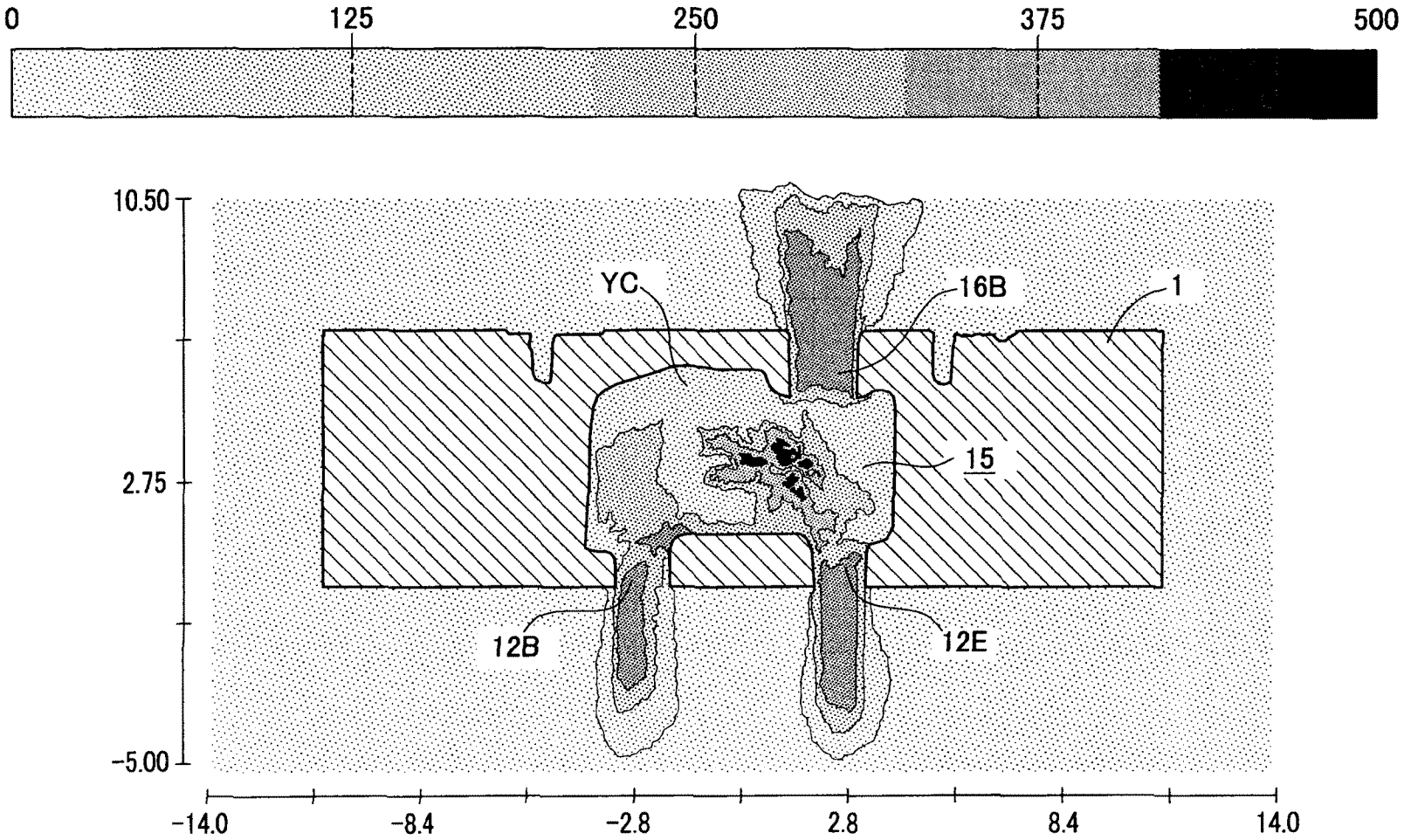
FIG. 20 is a sectional view taken along a line F-F in FIG. 19.

FIG. 19 is a view showing a result of simulating the flow distribution of the cleaning liquid in the case where the cylinder head 1 of FIG. 1 is subjected to the pseudo in-water cleaning. FIG. 20 is a sectional view taken along a line F-F.

In the cylinder head 1 subjected to the in-water cleaning, a flow of the cleaning liquid of 2.5 L/min to 5.0 L/min is created over the entire flow path from the narrow space portions ZB1 to ZB4 and ZC1 to ZC4 to the large space portion YC. In particular, the cleaning liquid jets colliding with each other in the large space portion YC are energetically spout at about 3 L/min from the sand removing hole 16B.

In the case where the cylinder head 1 is subjected to the pseudo in-water cleaning, the cleaning liquid jets ejected from the first cleaning nozzles 28A and 28C continue to flow at the initial velocity in the narrow space portions ZB1 to ZB4 and ZC1 to ZC4 and flow into the large space portion YC. The cleaning liquid jets flowing in opposite directions and colliding with each other in the large space portion YC then swiftly flow toward the sand removing hole 16B opening in the large space portion YC.

Comparing between the pseudo in-water cleaning and the in-air cleaning, the pseudo in-water cleaning shown in FIG. 18 can cause the cleaning liquid ejected from the first cleaning nozzles 28A and 28C to continue to flow at the initial velocity in a wider range than the in-air cleaning shown in FIG. 16 and can cover almost the narrow space portions ZB1 to ZB4 and ZC1 to ZC4 located between the first cleaning nozzles 28A and 28C (see the black sections). Because the square of the flow velocity is fluid pressure, a force of sweeping the foreign matters P is larger as the range in which the cleaning liquid is caused to flow at a high flow velocity is wider. In the pseudo in-water cleaning, the flow velocity of 5 m/sec or more is ensured near the sand removing hole 16B through which the cleaning liquid is discharged. This flow velocity is about five times as high as that in the in-air cleaning.

In the pseudo in-water cleaning shown in FIGS. 19 and 20, as compared with the in-air cleaning shown in FIG. 17, a larger amount of the cleaning liquid ejected from the first cleaning nozzles 28A and 28C is caused to flow through the flow paths extending from the narrow space portions ZB1, ZB3, ZC2, and ZC4 to the large space portion YC. Accordingly, the pseudo in-water cleaning can produce a faster flow of the cleaning liquid from the ejection positions to the discharge position as compared with the in-air cleaning, thereby easily discharging the foreign matters P out of the cylinder head 1 without allowing the foreign matters P to go to the bottom of the water jacket 15.

As above, the pseudo in-water cleaning can provide faster velocity range and larger flow amount than the in-air cleaning for the following reasons. Since the cleaning liquid is supplied to the water jacket 15 through the second cleaning nozzles 32A to 32F, the cleaning liquid ejected from the first cleaning nozzles 28A and 28C are unlikely to loss energy with respect to the water jacket inner wall while flowing through the narrow space portions ZB1 to ZB4 and ZC1 to ZC4 by changing the flowing directions, and to attenuate the flow velocity and the fluid pressure. In addition, in the pseudo in-water cleaning, the cleaning liquid flows upward from right below the sand removing hole 16B and joins with the cleaning liquid flowing from the narrow space portions ZB1, ZB3, ZC2, and ZC4 to the large space portion YC, right under the sand removing hole 16B through which the cleaning liquid is discharged, thereby prompting the flow velocity and the flow toward the sand removing hole 16B.

<Check on Discharge of Foreign Matters by Real Machine>

An experiment to check the discharge of foreign matters by use of a real machine will be explained below.

In this experiment, O-rings are used in substitution for foreign matters such as chippings in the water jacket 15 of the cylinder head 1. Seven O-rings (twenty-eight O-rings in total) are set in each narrow zone constituted of the narrow space portion Z formed around the spark plug hole 2 (e.g., a narrow zone corresponding to the spark plug hole 2A is constituted of the narrow space portions ZA1, ZA2, ZA3, and ZA4). In the experiment, the cylinder head in which the O-rings are set in each narrow zone is mounted in the cylinder head cleaning device 20. The mounted cylinder head 1 is subjected to the in-air cleaning or the pseudo in-water cleaning. The rate of movement and the rate of removal of the O-rings are examined. The experiment is conducted five times for each of the in-air cleaning and the pseudo in-water cleaning and averages of the rate of movement and the rate of removal of the O-rings are determined.

As a result, in the case of subjecting the cylinder head 1 to the in-air cleaning, the rate of removal of O-rings is 57.1% and the rate of movement of O-rings is 78.6%.

On the other hand, in the case of subjecting the cylinder head 1 to the pseudo in-water cleaning, the rate of removal of O-rings is 97.9% and the rate of movement of O-rings is 94.3%.

Furthermore, the inventors cleaned the cylinder head in the same manner as the pseudo in-water cleaning by sinking the cylinder head 1 in a cleaning bath (hereinafter, referred to as "in-water cleaning"). As a result, the rate of movement of O-rings is 100% and the rate of removal of O-rings is 92.9%.

It is therefore revealed that, the in-air cleaning, the rate of removal of foreign matters is low but the rate of movement of foreign matters is as high as 80% and thus the in-air cleaning could efficiently move the foreign matters from the narrow space portions. On the other hand, it is revealed that, in the pseudo in-water cleaning in which the water jacket 15 is placed in the pseudo in-water state, the rate of movement of foreign matters is greatly increased than that in the in-air cleaning and approximated to that in the in-water cleaning. It is further revealed that even the in-air cleaning could move nearly 80% of the foreign matters but the pseudo in-water cleaning could achieve the rate of movement of nearly 100% of foreign matters. In addition, the pseudo in-water cleaning is found to achieve a higher rate of removal of foreign matters than the in-water cleaning.

In this experiment, it is confirmed that, in both of the in-air cleaning and the pseudo in-water cleaning, the O-rings set in the narrow zones including the spark plug hole 2A could be discharged through the cooling-water outlet 14, the O-rings set in the narrow zones including the spark plug holes 2B and 2C could be discharged through the sand removing hole 16B, and the O-rings set in the narrow zones including the spark plug hole 2D could be discharged through the water jacket port 13.

In other words, it is confirmed that, regardless of the in-air cleaning and the pseudo in-water cleaning, when the cleaning liquid is ejected at different narrow space portions Z by changing the orientations of the ejection ports 29A, 29B, and 29C of the first cleaning nozzles 28A, 28B, and 28C, the foreign matters caught in the narrow space portions Z could be discharged through the holes in which the first cleaning nozzles 28A, 28B, and 28C are not inserted, the holes being located on both sides of the holes in which the first cleaning nozzles 28A, 28B, and 28C are inserted.

<Operations and Effects>

As explained above, the cylinder head cleaning method and the cylinder head cleaning device 20 in this embodiment are configured to select, for example, the sand removing holes 16A and 16C from the plurality of holes 12A to 12R, 13, 14, 16A, 16B, and 16C of the cylinder head 1, insert the first cleaning nozzles 28A and 28C in the water jacket 15 through the sand removing holes 16A and 16C, and eject the cleaning liquid directly at the foreign matters P caught in the narrow space portions ZB1, ZB3, ZC2, and ZC4 in the water jacket. The cleaning liquid impinges on the foreign matters P while maintaining the flow velocity, flow quantity, fluid pressure determined at the time of ejection from the first cleaning nozzles 28A and 28C, thereby sweeping away the foreign matters P from the narrow space portions ZB1, ZB2, ZB3, ZB4, ZC1, ZC2, ZC3, and ZC4 to the large space portion YC. The foreign matters P flowing in the large space portion YC are discharged and removed together with the cleaning liquid to the outside of the cylinder head 1 through the sand removing hole 16B communicating with the large space portion YC. As above, the cylinder head cleaning method and the cylinder head cleaning device 20 in this embodiment can sufficiently remove even the foreign matters P caught in the narrow space portions ZB1, ZB2, ZB3, ZB4, ZC1, ZC2, ZC3, and ZC4 in the water jacket 15, thus enhancing the rate of removal of the foreign matters P.

Consequently, less foreign matters P are found in the visual inspection of the inside of the cylinder head 1 cleaned by the cylinder head cleaning method and the cylinder head cleaning device 20 in the present embodiment. Thus, the trouble of removing the foreign matters by hand can greatly be reduced.

In the cylinder head cleaning method in this embodiment, for example, the first cleaning nozzles 28A and 28C are inserted in the sand removing holes 16A and 16C selected to cause the cleaning liquid jets to be ejected in opposite directions into the cylinder head YC, and the cleaning liquid jets ejected from the first cleaning nozzles 28A and 28C join together in the large space portion YC and are discharged through the unselected sand removing hole 16B. Accordingly, it is possible to discharge the foreign matters P to the outside of the cylinder head 1 without allowing the foreign matters P from entering again the other narrow space portions ZA2, ZA4, ZD1, ZD3, and others.

In the cylinder head cleaning method in this embodiment, for example, the cleaning liquid is ejected through the narrow space portions ZB1, ZB2, ZB3, ZB4, ZC1, ZC2, ZC3, and ZC4 formed between the walls defining the spark plug holes 2B and 2C and the walls defining the intake ports 8B and 8C or the walls defining the exhaust ports 10B and 10C toward the large space portion YC formed between the walls of the spark plug holes 2B and 2C. Accordingly, the narrow space portions ZB1, ZB2, ZB3, ZB4, ZC1, ZC2, ZC3, and ZC4 are communicated with the large space portion YC at short distances. It is therefore possible to remove the foreign matters P without allowing the foreign matters P from entering again the other narrow space portions ZA1, ZA2, ZA3, ZA4, ZD1, ZD2, ZD3, and ZD4.

In the cylinder head cleaning method and the cylinder head cleaning device 20 in this embodiment, for example, the first cleaning nozzles 28A and 28C inserted in the water jacket 15 through the sand removing holes 16A and 16C are rotated to perform cleaning. Alternatively, for example, the first cleaning nozzle 28B is inserted and rotated in the water jacket 15 through the sand removing hole 16B and the third cleaning nozzles 34A and 34B are placed near the water jacket port 13 and the cooling-water outlet 14 respectively and swung to perform cleaning. Consequently, the cylinder head cleaning method and the cylinder head cleaning device 20 in this embodiment can clean the narrow space portions ZA2, ZA4, ZB1, ZB3, ZC2, ZC4, ZD1, and ZD3 by the cleaning liquid ejected at them through the sand removing holes 16A and 16C. A high cleaning efficiency is thus achieved.

The cylinder head cleaning method in this embodiment is achieved by, for instance, inserting the first nozzles 28A and 28C in the sand removing holes 16A and 16C to conduct cleaning of the water jacket 15 (first cleaning step S1) and, after the foreign matters P are removed from predetermined cleaning space (the large space portions YA, YC, and YE), inserting the first cleaning nozzle 28B in the unselected sand removing hole 16B, performing the cleaning of the water jacket 15 (second cleaning step S2) to remove the foreign matters P from the other cleaning space (the large space portions YB and YD). In the cylinder head cleaning method in this embodiment, as above, the water jacket 15 is intermittently cleaned by dividing it into a plurality of cleaning space portions to evenly clean the entire inside of the water jacket 15. Accordingly, it is possible to prevent the foreign matters removed from the narrow space portion ZB1 for example from becoming caught in another narrow space portion ZA2 and staying in the water jacket 15.

In the cylinder head cleaning method in this embodiment, for example, if the sand removing hole 16B communicating with the large space portion YC is selected as the cleaning liquid discharge hole, the sand removing holes 16A and 16C located on both sides of that discharge hole are selected as the holes in which the first cleaning nozzles 28A and 28C are to be inserted. Thus, the cleaning liquid jets ejected from the first cleaning nozzles 28A and 28C flow in opposite directions and collide with each other in the large space portion YC and easily flow to the outside of the cylinder head 1 through the discharge hole 16B.

In the cylinder head cleaning method and the cylinder head cleaning device 20 in this embodiment, the cleaning liquid is supplied to the cooling-water communication paths 12A to 12F provided in the surface defined as the lower surface 1B of the cylinder head 1 during cleaning, thereby placing the water jacket 15 in a pseudo in-water state. The water jacket 15 is designed as shown in FIG. 5 such that the flow paths have a narrower width as they are closer to the lower surface 1B of the cylinder head 1 around the spark plug holes 2A, 2B, 2C, and 2D, thereby forming the narrow space portions ZA1, ZA2, ZA3, . . . . In the pseudo in-water state of the water jacket 15, the foreign matters P are given buoyancy and the gravity acting on the foreign matters P has less influence on the foreign matters P. Thus, the foreign matters P are allowed to easily separate from the narrow space portions P. In addition, the cleaning liquid jets ejected from the first cleaning nozzles 28A and 28C are unlikely to loss energy with respect to the inner wall of the water jacket 15 during flowing through the narrow space portions ZA1, ZA2, . . . because the cleaning liquid stays in the water jacket 15. It is therefore possible to cause the cleaning liquid to flow through the narrow space portions ZA1, ZA2, . . . while maintaining the initial velocity determined at the time of ejection from the first cleaning nozzles 28A and 28C. Since the flow quantity less varies between the narrow space portions Z in which the cleaning liquid is ejected and the large space portions Y, a large flow amount can be ensured even near the sand removing hole 16B through which the cleaning liquid is discharged. Accordingly, the flow velocity is unlikely to lower even after the cleaning liquid flows from the narrow space portions Z to the large space portions Y. The cylinder head cleaning method and the cylinder head cleaning device 20 in this embodiment can remove the foreign matters P from the narrow space portions Z and easily create a flow of the cleaning liquid whereby to sweep away the foreign matters P toward the sand removing hole 16B without allowing the foreign matters P to be caught in other narrow space portions Z. The rate of removal of foreign matters P can therefore be enhanced.

In addition, the cylinder head cleaning method and the cylinder head cleaning device 20 in this embodiment adopting the pseudo in-water cleaning can achieve the removal rate of foreign matters equal to or more than that in the in-water cleaning. Accordingly, any tank for immersing the cylinder head 1 in the cleaning liquid is not required. This is an advantage in cost and space.

In the cylinder head cleaning method and the cylinder head cleaning device 20 in this embodiment, during cleaning of the cylinder head 1, the first flow paths 25A, 25B, and 25C of the cleaning liquid discharge member 23 are connected to the sand removing holes 16A, 16B, and 16C each opening in the upper surface of the cylinder head 1, and the first cleaning nozzles 28A, 28B, and 28C are inserted in the first flow paths 25A, 25B, and 25C. For instance, the first cleaning nozzles 28A and 28C corresponding to the sand removing holes 16A and 16C are inserted in the water jacket 15 and stopped in the first stop position X1, while the first cleaning nozzle 28B corresponding to the sand removing hole 16B is stopped in the second stop position X2, whereby allowing the second flow path 26B to branch off from the first flow path 25B. Then, the cleaning liquid is ejected through the first cleaning nozzles 28A and 28C. The upper opening of the first flow path 25B communicating with the sand removing hole 16B is blocked off by the first cleaning nozzle 28C. The cleaning liquid therefore flows from the first flow path 25B connected to the sand removing hole 16B to the second flow path 26B, and then flows out to the side of the side surface of the cylinder head 1. According to the cylinder head cleaning method and the cylinder head cleaning device 20 in this embodiment, consequently, it is possible to prevent the foreign matters P removed out of the cylinder head 1 from entering the cylinder head 1 again.

In particular, the cleaning liquid discharge member 23 has a larger planar dimension than the cylinder head 1 and the openings of the second flow paths 26A, 26B, and 26C are located outside of the cylinder head 1. Accordingly, the discharged cleaning liquid is not splashed on the cylinder head 1 and the foreign matters P do not stick to the cylinder head 1 again.

<Modified Example>

The present invention is explained in the embodiment but is not limited thereto. The invention may be embodied in other specific forms without departing from the essential characteristics thereof.

Figure 21:
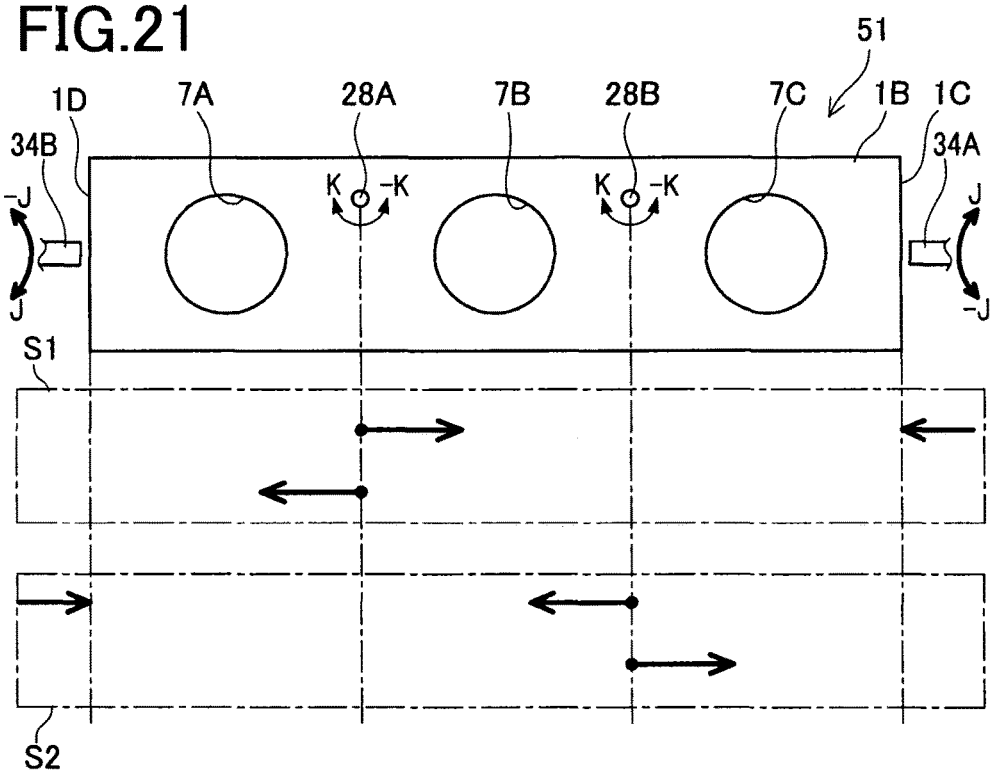
FIG. 21 is a conceptual view showing an example of a cleaning pattern for cleaning a three-cylinder cylinder head by the cleaning device of FIG. 6, including different columns per cleaning step to explain a cleaning method with arrows indicating directions of ejecting cleaning liquid.
Figure 22:
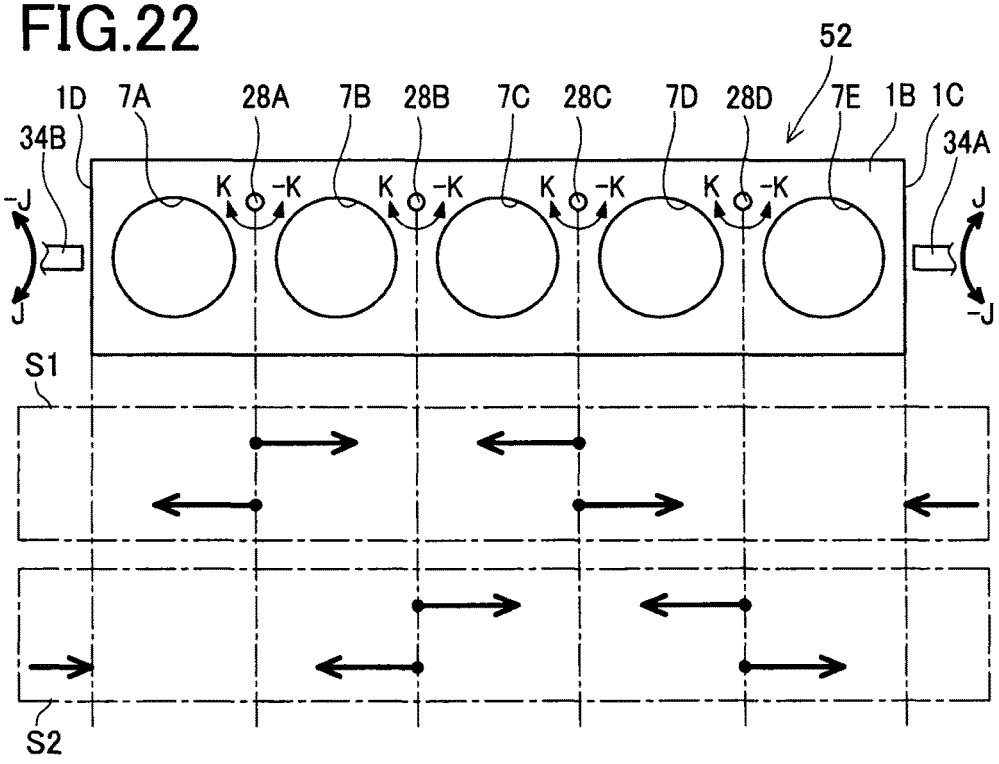
FIG. 22 is a conceptual view showing an example of a cleaning pattern for cleaning a five-cylinder cylinder head by the cleaning device of FIG. 6, including different columns per cleaning step to explain a cleaning method with arrows indicating directions of ejecting cleaning liquid.
Figure 23:
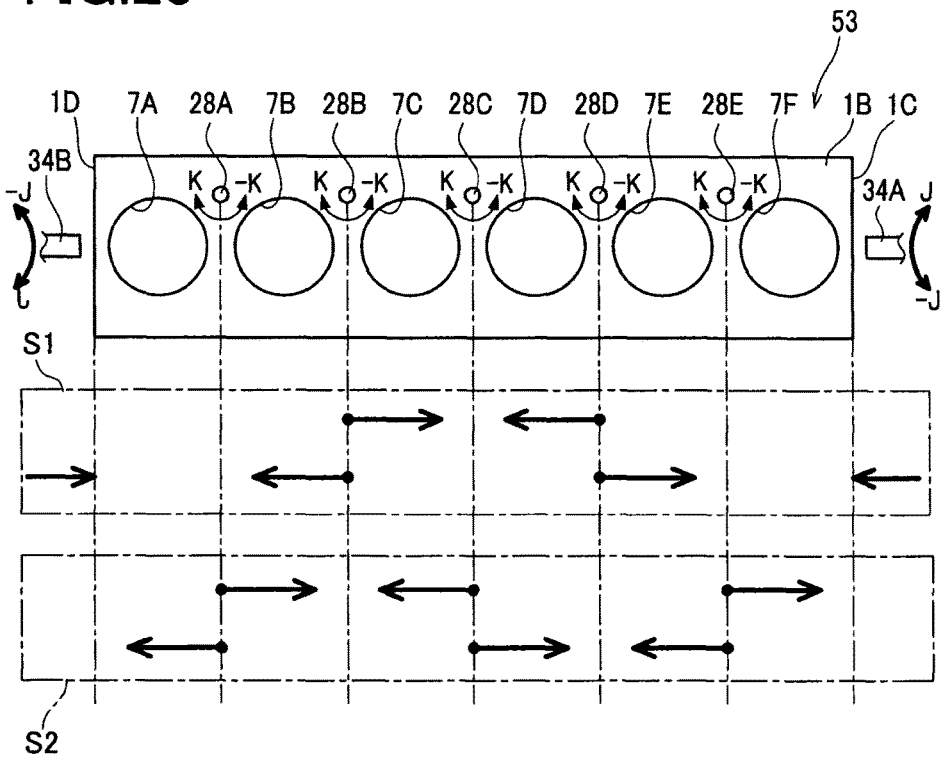
FIG. 23 is a conceptual view showing an example of a cleaning pattern for cleaning a six-cylinder cylinder head by the cleaning device of FIG. 6, including different columns per cleaning step to explain a cleaning method with arrows indicating directions of ejecting cleaning liquid.
Figure 24A:
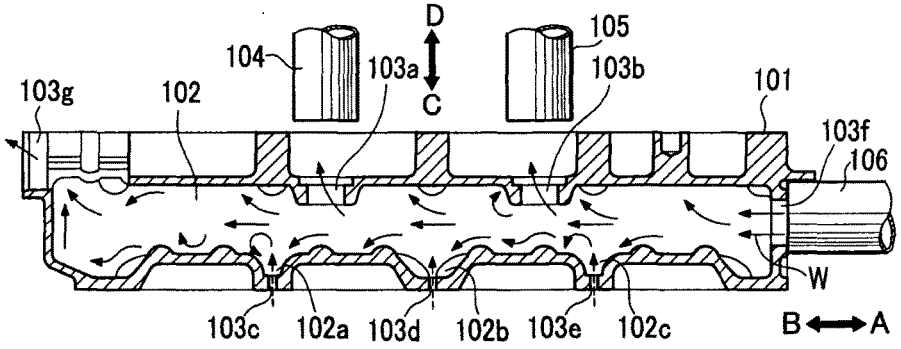
FIG. 24A is a view to explain a conventional cylinder head cleaning method, showing a first cleaning step.
Figure 24B:
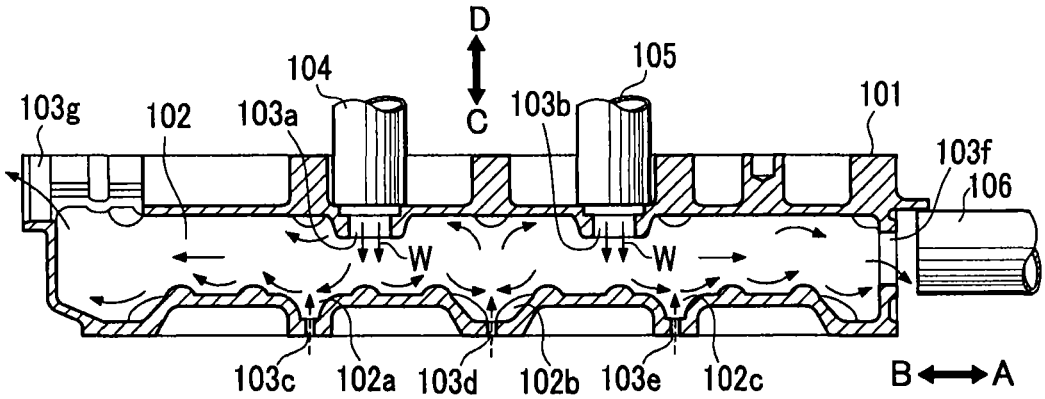
FIG. 24B is a view to explain the conventional cylinder head cleaning method, showing a second cleaning step.
Figure 24C:
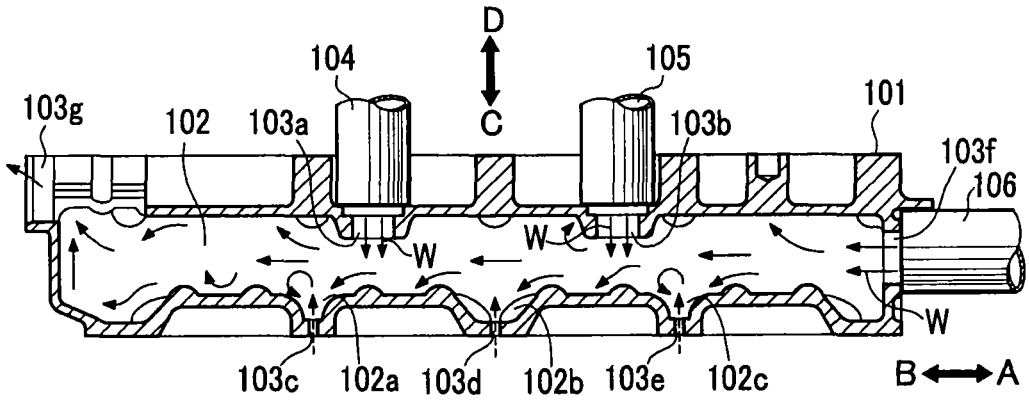
FIG. 24C is a view to explain the conventional cylinder head cleaning method, showing a third cleaning step.
Figure 25:
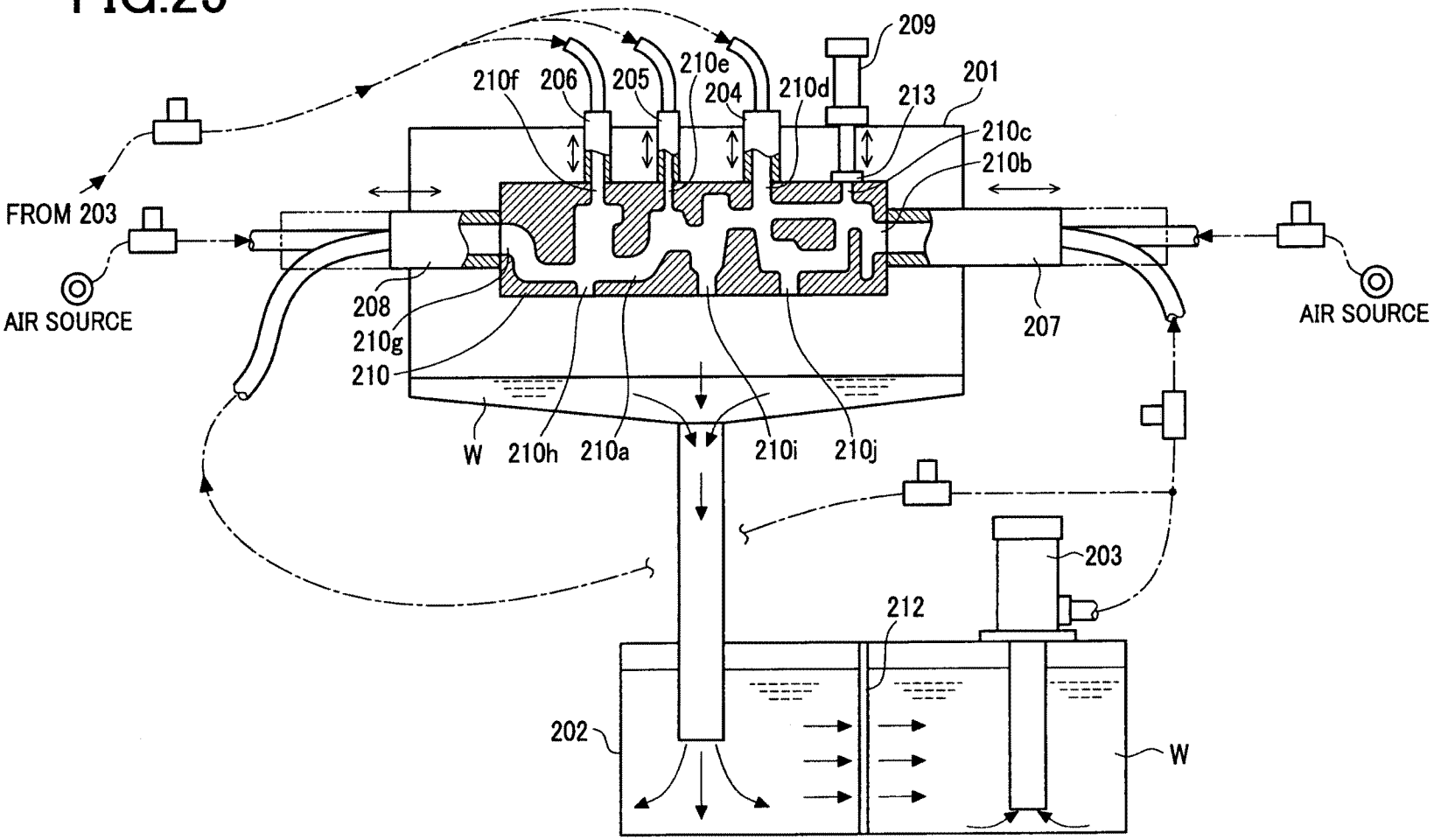
FIG. 25 is a schematic configuration view of a conventional cylinder head cleaning device.

For instance, the above embodiment describes the method of cleaning the cylinder head to be used in the four-cylinder engine. As other examples, the cylinder head cleaning device 20 and the cylinder head cleaning method in the above embodiment may be applied to the cleaning of cylinder heads 51, 52, and 53 to be used in a three-cylinder or five-cylinder engine shown in FIGS. 21 to 23. In each case, the cleaning is preferably conducted in such a way that, when one sand removing hole 16 communicating with the large space portion is to be used as the discharge hole, other sand removing holes 16 located on both sides of the discharge hole are selected and the first cleaning nozzles 28 are inserted therein to the first stop position and simultaneously the first cleaning nozzle 28 for the discharge hole is stopped in the second stop position, as indicated by arrows in FIGS. 21 to 23. During cleaning, preferably, the first cleaning nozzles 28 inserted in the selected sand removing holes 16 are rotated selectively in the normal direction K and the reverse direction −K (the third cleaning nozzles 34A and 34B are swung), thereby ejecting the cleaning liquid at a plurality of narrow space portions for cleaning. After the cleaning with the first cleaning nozzles 28 inserted in the selected sand removing holes 16, the first cleaning nozzles 28 in the selected sand removing holes 16 are retracted back from the first stop position to the second stop position, the first cleaning nozzle 28 in the unselected sand removing hole 16 is moved ahead from the second stop position to the first stop position to conduct the cleaning. In this way, when the cleaning is conducted by the inserting the first cleaning nozzles 28 in turn in the sand removing holes 16, the entire water jacket of each cylinder head 51 to 53 is evenly cleaned.

In the above embodiment, for instance, the first cleaning nozzles 28A, 28B, and 28C are provided in correspondence with the sand removing holes 16A, 16B, and 16C and made movable only up and down in the vertical direction. In another alternative, the first cleaning nozzles 28 are made movable up and down in the vertical direction and right and left and back and forth in the horizontal direction. In this case, each first cleaning nozzle 28 is moved right and left and back and forth in the horizontal direction to be placed above each selected hole. Then, each first cleaning nozzle 28 is moved down to be inserted in each selected hole.

The invention claimed is:

1. A cylinder head cleaning method of cleaning a cylinder head, the cylinder head internally comprising a water jacket including narrow space portions forming a narrow part of a flow path and large space portions forming a wider part of the flow path than in the narrow space portions; and a plurality of holes each defined by the flow path formed between a surface of the cylinder head and the water jacket, the holes including a plurality of first holes communicating the large space portions to outside of the cylinder head, the method comprising:

selecting holes from the first holes through which cleaning liquid is allowed to flow into a first large space portion of the large space portions from two opposite directions that will cause a collision of jets of the cleaning liquid in the first large space portion, as the jets flow directly from the selected holes, to first narrow space portions of the narrow space portions, and then to the first large space portion;

inserting cleaning nozzles into the water jacket through the selected first holes, respectively;

ejecting cleaning liquid through each of the cleaning nozzles inserted in the selected first holes towards the first narrow space portions so that the jets of the cleaning liquid flow directly from the first narrow space portions to the first large space portion from the two opposite directions to collide in the first large space portion, the cleaning liquid pushing foreign matters in the first narrow space portions into the first large space portion; and discharging the cleaning liquid including the foreign matters to the outside of the cylinder head from the first large space portion through an unselected first hole in which no cleaning nozzle is inserted and which communicates directly with the first large space portion and the outside of the cylinder head.

2. The cylinder head cleaning method according to claim 1, wherein the cylinder head comprises:

a plurality of combustion chambers;

spark plug holes which are formed to communicate with the combustion chambers, respectively, and in each of which a spark plug is to be mounted;

intake ports formed to respectively communicate with the combustion chambers, the intake ports being used for taking in air; and exhaust ports formed to respectively communicate with the combustion chambers and used for discharging exhaust gas, each of the narrow space portions is a space formed between a wall defining each spark plug hole and a wall defining each intake port or a wall defining each exhaust port, and each of the large space portions is a space formed between walls adjacent to the spark plug holes or a space formed between a spark plug hole and an end face of the cylinder head.

3. The cylinder head cleaning method according to claim 2, wherein the unselected first hole in which no cleaning nozzle is inserted is at a top of the space formed between walls adjacent to the spark plug holes or the space formed between the spark plug hole and the end face of the cylinder head.

4. The cylinder head cleaning method according to claim 1, wherein the cleaning nozzles are rotated in the water jacket.

5. The cylinder head cleaning method according to claim 1, wherein the cleaning nozzles are inserted in the selected first holes and cleaning is conducted, and then the cleaning nozzle is inserted in the unselected first hole or unselected first holes and cleaning is conducted.

6. The cylinder head cleaning method according to claim 1, wherein when one first hole communicating with a large space portion is to be used as a discharge hole of the cleaning liquid, two first holes located adjacent to the discharge hole are selected as holes in which the cleaning nozzles are to be inserted.

7. The cylinder head cleaning method according to claim 6, wherein the plurality of holes include a second hole provided in a surface of the cylinder head, the surface being defined as a lower surface of the cylinder head during cleaning, to allow the cleaning liquid to be supplied into the water jacket through the second hole.

8. The cylinder head cleaning method according to claim 6, wherein the first holes include a hole opening on a side surface of the cylinder head, the method further comprising:

placing the cleaning nozzle near the hole opening on the side surface of the cylinder head;

swinging the cleaning nozzle to change an ejecting direction of the cleaning liquid; and ejecting the cleaning liquid toward the narrow space portion to discharge the cleaning liquid flowing from the narrow space portion to the large space portion to the outside of the cylinder head through the unselected first hole in which no cleaning nozzle is inserted and which communicates with the large space portion.

9. The cylinder head cleaning method according to claim 1, the plurality of holes include a second hole provided in a surface of the cylinder head, the surface being defined as a lower surface of the cylinder head during cleaning, to allow the cleaning liquid to be supplied into the water jacket through the second hole.

10. The cylinder head cleaning method according to claim 1, wherein the first holes include a hole opening on a side surface of the cylinder head, the method further comprising:

placing the cleaning nozzle near the hole opening on the side surface of the cylinder head;

swinging the cleaning nozzle to change an ejecting direction of the cleaning liquid; and ejecting the cleaning liquid toward the first narrow space portions to discharge the cleaning liquid flowing from a narrow space portion to a large space portion to the outside of the cylinder head through the unselected first hole in which no cleaning nozzle is inserted and which communicates with the large space portion.

11. A cylinder head cleaning method of cleaning a cylinder head, the cylinder head internally comprising a water jacket including narrow space portions forming a narrow part of a flow path and large space portions forming a wider part of the flow path than in the narrow space portions; and a plurality of holes each defined by the flow path formed between a surface of the cylinder head and the water jacket, the holes including a plurality of first holes communicating the large space portions to outside of the cylinder head, the method comprising:

selecting holes from the first holes through which cleaning liquid is allowed to flow into a first large space portion of the large space portions from two opposite directions that will cause a collision of jets of the cleaning liquid in the first large space portion, as the jets flow directly from the selected holes, to first narrow space portions of the narrow space portions, and then to the first large space portion;

inserting cleaning nozzles into the water jacket through the selected first holes, respectively;

ejecting cleaning liquid through each of the cleaning nozzles inserted in the selected first holes towards the first narrow space portions so that the jets of the cleaning liquid flow directly from the first narrow space portions to the first large space portion from the two opposite directions to collide in the first large space portion; and discharging the cleaning liquid to the outside of the cylinder head from the first large space portion through an unselected first hole in which no cleaning nozzle is inserted and which communicates directly with the first large space portion and the outside of the cylinder head.

* * * * *